US009848753B2

(12) United States Patent
Chan et al.

(10) Patent No.: US 9,848,753 B2
(45) Date of Patent: Dec. 26, 2017

(54) DISHWASHER BASKET WITH ADJUSTABLE TRAY

(71) Applicants: Sung Yun Chan, Pasadena, CA (US); Nicholas Trumbo, La Canada, CA (US); Thomas Birkert, West Hills, CA (US)

(72) Inventors: Sung Yun Chan, Pasadena, CA (US); Nicholas Trumbo, La Canada, CA (US); Thomas Birkert, West Hills, CA (US)

(73) Assignee: MUNCHKIN, INC., Van Nuys, CA (US)

( * ) Notice: Subject to any disclaimer, the term of this patent is extended or adjusted under 35 U.S.C. 154(b) by 0 days.

(21) Appl. No.: 14/458,370

(22) Filed: Aug. 13, 2014

(65) Prior Publication Data

US 2015/0048091 A1 Feb. 19, 2015

Related U.S. Application Data

(60) Provisional application No. 61/865,567, filed on Aug. 13, 2013.

(51) Int. Cl.
*A47L 15/50* (2006.01)
*B65D 25/06* (2006.01)
(Continued)

(52) U.S. Cl.
CPC ..... *A47L 15/505* (2013.01); *B65D 25/06* (2013.01); *A47L 15/502* (2013.01); *B65D 1/38* (2013.01);
(Continued)

(58) Field of Classification Search
CPC ..... A47L 15/50; A47L 15/502; A47L 15/504; A47L 15/505; A61L 12/07; B01D 21/0036; B65D 25/08; B65D 81/263; B65D 25/06; D06F 1/12; D06F 5/005; D06F 59/00; D06F 95/006
(Continued)

(56) References Cited

U.S. PATENT DOCUMENTS 1,055,522 A * 3/1913 Cumming ..... A47B 57/42 126/337 R
1,527,326 A 2/1925 Owens
(Continued)

FOREIGN PATENT DOCUMENTS

DE 3641020 C1 4/1988
DE 29818725 U1 2/1999
(Continued)

*Primary Examiner* — Steven A. Reynolds
*Assistant Examiner* — Mollie Impink
(74) *Attorney, Agent, or Firm* — Robert Z. Evora, Esq.; Christian Lek

(57) ABSTRACT

A dishwasher basket having a container, an interior frame, at least one height adjustable rack, a lid and a connection assembly that hingedly couples the container, the interior frame and the lid together. The height adjustable rack may be fastened and moved vertically via a tray securing assembly to vary a volume of an upper compartment and a lower compartment. The lid may have at least one slot for securely holding a portion of a nipple or pacifier, at least one of which slots may be spaced to receive the nipple while the lid remains in a closed position.

22 Claims, 22 Drawing Sheets

(51) Int. Cl.

| | |
|---|---|
| *B65D 1/38* | (2006.01) |
| *D06F 1/12* | (2006.01) |
| *B65D 43/22* | (2006.01) |
| *B65D 43/16* | (2006.01) |

(52) U.S. Cl.
CPC ..... *B65D 43/161* (2013.01); *B65D 43/164* (2013.01); *B65D 43/22* (2013.01); *D06F 1/12* (2013.01)

(58) Field of Classification Search
USPC ..... 108/147.11, 61; 220/4.22, 485–488, 554; 422/26, 292, 297, 300; 206/438, 439; D9/426, 427; D32/3, 58
See application file for complete search history.

(56) References Cited

U.S. PATENT DOCUMENTS 2,586,005 A 2/1952 Colonna
2,655,283 A * 10/1953 Moldt ..... B65D 21/045 206/507
2,741,392 A 4/1956 Weiss
3,182,854 A * 5/1965 Geller ..... A47L 15/502 206/553
3,934,728 A 1/1976 Guth
4,113,329 A * 9/1978 Thurman ..... B65D 11/14 206/509
4,193,588 A 3/1980 Doneaux
4,316,477 A 2/1982 Song
4,495,150 A 1/1985 Cook et al.
4,498,594 A 2/1985 Elder
4,512,489 A 4/1985 Green et al.
4,577,760 A 3/1986 Rainin et al.
4,732,291 A 3/1988 McConnell
4,744,612 A * 5/1988 Winter ..... A47B 57/48 211/186
4,748,993 A 6/1988 Llewellyn
4,830,200 A * 5/1989 Zambano ..... A47L 15/505 211/133.5
4,836,392 A 6/1989 Constantino
4,850,495 A 7/1989 Wallace
5,076,445 A * 12/1991 Landsberger ..... B01L 9/06 211/60.1
5,209,784 A 5/1993 Bellman
5,287,984 A 2/1994 Michael
5,344,029 A 9/1994 Oghia et al.
5,392,915 A * 2/1995 Kalin ..... B65D 25/06 206/503
5,431,294 A 7/1995 Scottmann et al.
5,480,035 A 1/1996 Smith
5,649,630 A 7/1997 Remmler
5,840,261 A 11/1998 Monch
5,893,618 A * 4/1999 LePage, Jr. ..... A61L 2/26 312/209
6,089,411 A 7/2000 Baudin et al.
6,325,220 B1 12/2001 Malmstrom
6,371,642 B1 4/2002 Nelson et al.
6,571,965 B1 6/2003 Beck et al.
D488,891 S 4/2004 Smith et al.
6,814,091 B2 * 11/2004 McConnell ..... A47L 15/505 134/135
7,383,846 B2 6/2008 Curran
7,621,287 B2 * 11/2009 Rosenbauer ..... A47L 15/502 134/135
7,861,883 B2 * 1/2011 Purushothaman .... A47L 15/502 206/553
2002/0179604 A1 12/2002 Germain
2003/0205258 A1 11/2003 McConnell et al.
2003/0205259 A1 11/2003 McConnell et al.
2004/0040586 A1 3/2004 Kumar
2004/0123885 A1 7/2004 Myong
2004/0169002 A1 9/2004 White-Wooten
2008/0121253 A1 * 5/2008 Shotwell ..... A47L 15/505 134/25.4
2008/0128371 A1 * 6/2008 Oppel ..... A47L 15/502 211/70.7
2010/0193453 A1 * 8/2010 Dunn ..... A47L 15/505 211/60.1
2013/0101708 A1 * 4/2013 Short ..... B65D 43/22 426/106

FOREIGN PATENT DOCUMENTS

| | | | |
|---|---|---|---|
| EP | 0272795 | A2 | 6/1988 |
| EP | 0272795 | A3 | 7/1988 |
| EP | 0272795 | B1 | 7/1992 |
| EP | 1275336 | A1 | 1/2003 |
| FR | 2643809 | A1 | 9/1990 |
| JP | 406217920 | A | 8/1994 |
| WO | WO02087407 | A1 | 11/2002 |
| WO | WO2006063899 | | 6/2006 |

* cited by examiner

DISHWASHER BASKET WITH ADJUSTABLE TRAY

CROSS REFERENCE TO RELATED APPLICATION

This application claims priority to U.S. Provisional Application Ser. No. 61/865,567 filed Aug. 13, 2013; the contents of all of which are hereby incorporated by reference herein in their entirety into this disclosure.

TECHNICAL FIELD

The subject disclosure relates generally to the field of dishwasher racks, baskets and accessories. In particular, the invention relates to a dishwasher basket within an adjustable tray provided with nipple holders and pacifier holders for use with dishwashers.

BACKGROUND

A wide variety of accessories are used in the feeding and care of infants and children. Four of the products currently used are pacifiers, baby bottles, straw cups, and non-spill cups. These products typically have parts that are small and difficult to contain and wash properly in current dishwashing machines. Baby bottles have nipples, and cups can have straws and/or valves. Pacifiers, nipples, straws and valves tend to be small and awkwardly shaped and fall from dishwasher racks during the washing process. This makes it difficult to effectively clean pacifiers, nipples, straws and valves in current dishwashers.

In order to clean pacifiers, nipples, straws and valves effectively it is necessary that the interiors be struck in a particular direction with the water from dishwasher's cleaning jets. The cleaning jets typically shoot water from a bottom surface of dishwasher upwards. Current dishwashers typically have products placed randomly in a basket or in some other dishwasher accessory. While washing, the products are free to move around inside the basket. If a product is flipped upside-down during washing, it will not be effectively cleaned and may collect water. Furthermore, once the lid is removed the products are frequently lost, misplaced and/or difficult to relocate. Unfortunately, this deficiency has not been solved and has never been addressed previously.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Figure 1:
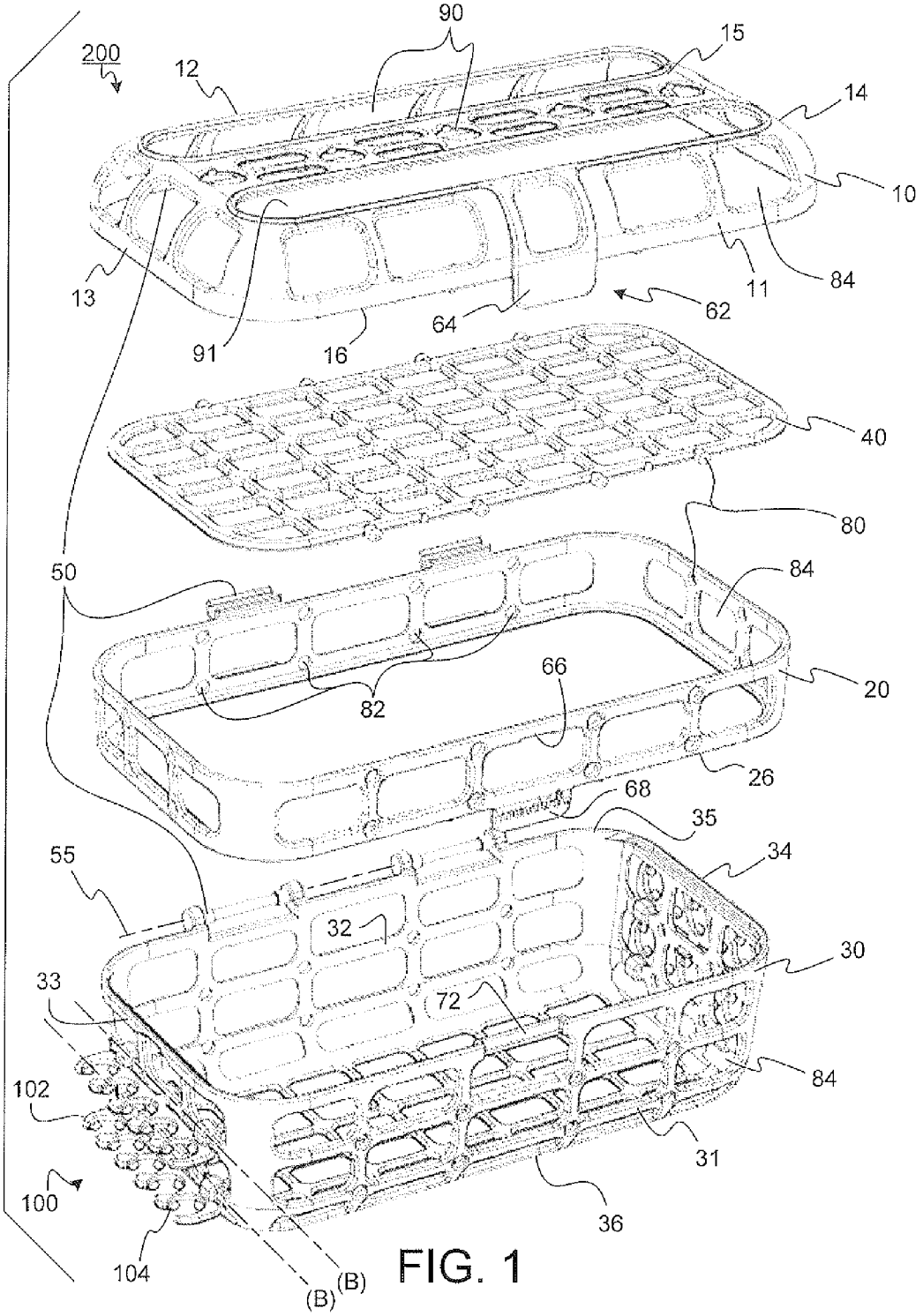
FIG. 1 shows a front perspective exploded view of a dishwasher basket having a lid, intermediate frame, container, and adjustment tray.

Particular embodiments of the present invention will now be described in greater detail with reference to the figures.

FIGS. 1-5 show exploded views of a dishwasher basket 200. The dishwasher basket 200 is perforated with various apertures 84 throughout its structure to enable the free flow of fluid throughout the dishwasher basket 200. The apertures 84 may be a variety of shapes, sizes and locations throughout the dishwasher basket 200. The dishwasher basket 200 is designed to be used within a dishwasher. Small articles, such as pacifiers, nipples, straws, valves, etc. may be placed within compartments throughout the dishwasher basket 200 in order to prevent the smaller articles from becoming lost within the dishwasher. The dishwasher basket 200 comprises a lid 10, an intermediate frame 20, a container 30, an adjustment tray 40, a straw holder 100, a locking system 60 and a connection assembly 50 that couples the container 30, the intermediate frame 20 and the lid 10 together. The connection assembly includes a lid hinge 53, frame hinges 54*a*, 54*b* and a container hinge 56. The locking system 60 includes a lid locking member 62, a lid engagement portion 66, a frame locking member 68 and a frame engagement portion 72.

Figure 6:
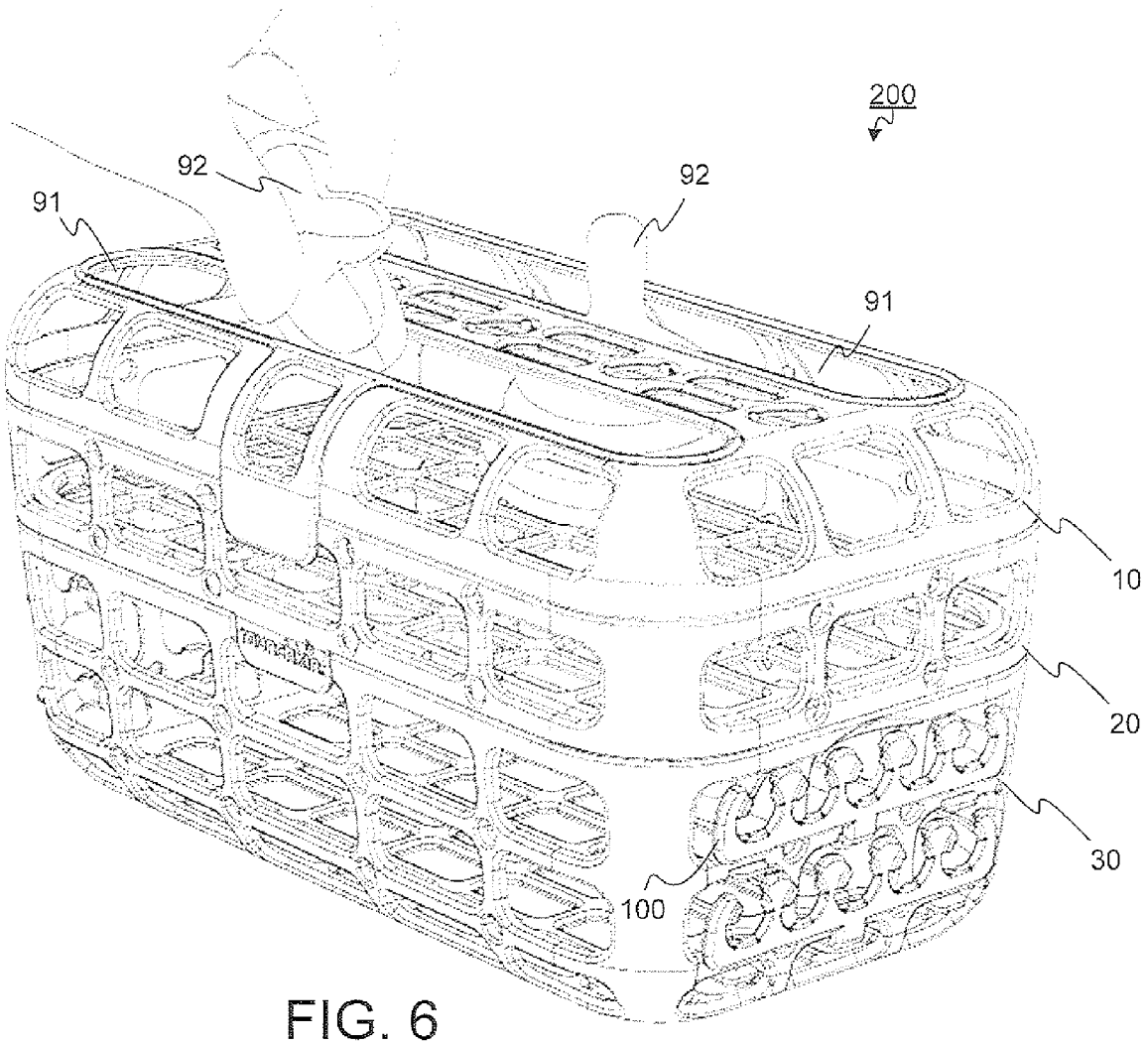
FIG. 6 illustrates a front perspective view of a user loading a nipple through a nipple slot into the dishwasher basket.

The lid 10 has an inverted U-shaped construction with various perforations 84 there around. The lid 10 comprises a front face 11, a back face 12, two side faces 13, 14, a top face 15, and a bottom edge 16. The lid 10 includes at least one slot 90 for securely holding a portion of a nipple 92 (as shown in FIG. 6). The slots 90 may be in the form of an elongated slot 91 running parallel to either the front face 11 or side face 13, 14. As shown in the lid 10, the slots 90 may also be substantially round, circular, elliptical, race-track shaped or any other suitable size and shape for holding a portion of the nipple 92.

Figure 5:
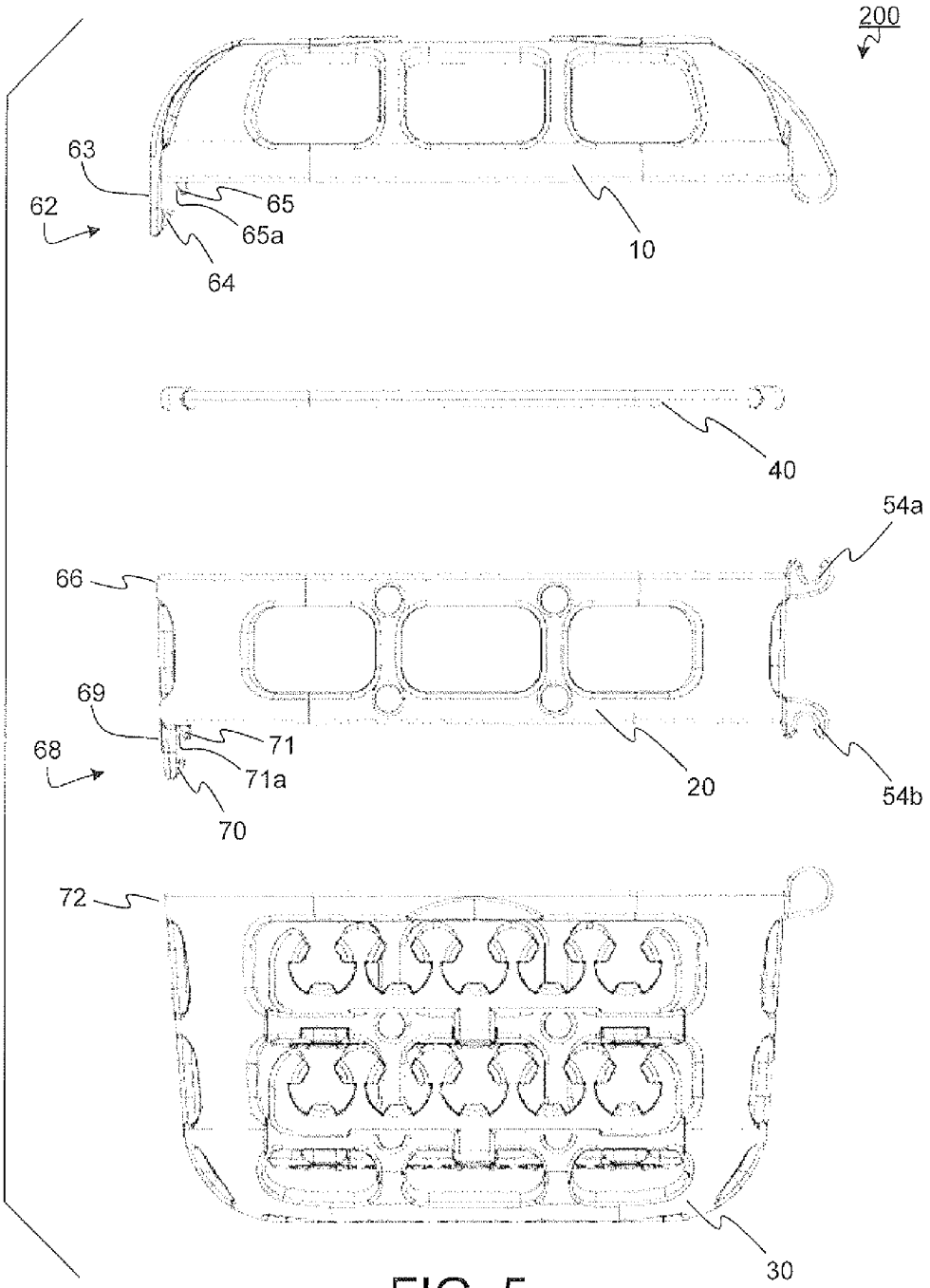
FIG. 5 shows a side exploded view of the dishwasher basket.

The front face 11 of the lid 10 comprises a lid locking member 62, which is part of a locking system 60. The locking system 60 is described in more detail below. As shown in FIG. 5, the lid locking member 62 comprises a downwardly projecting lip 63, an inward protrusion 64 projecting from the lip 63, and a stopper 65 having an angled surface 65*a*.

Figure 2:
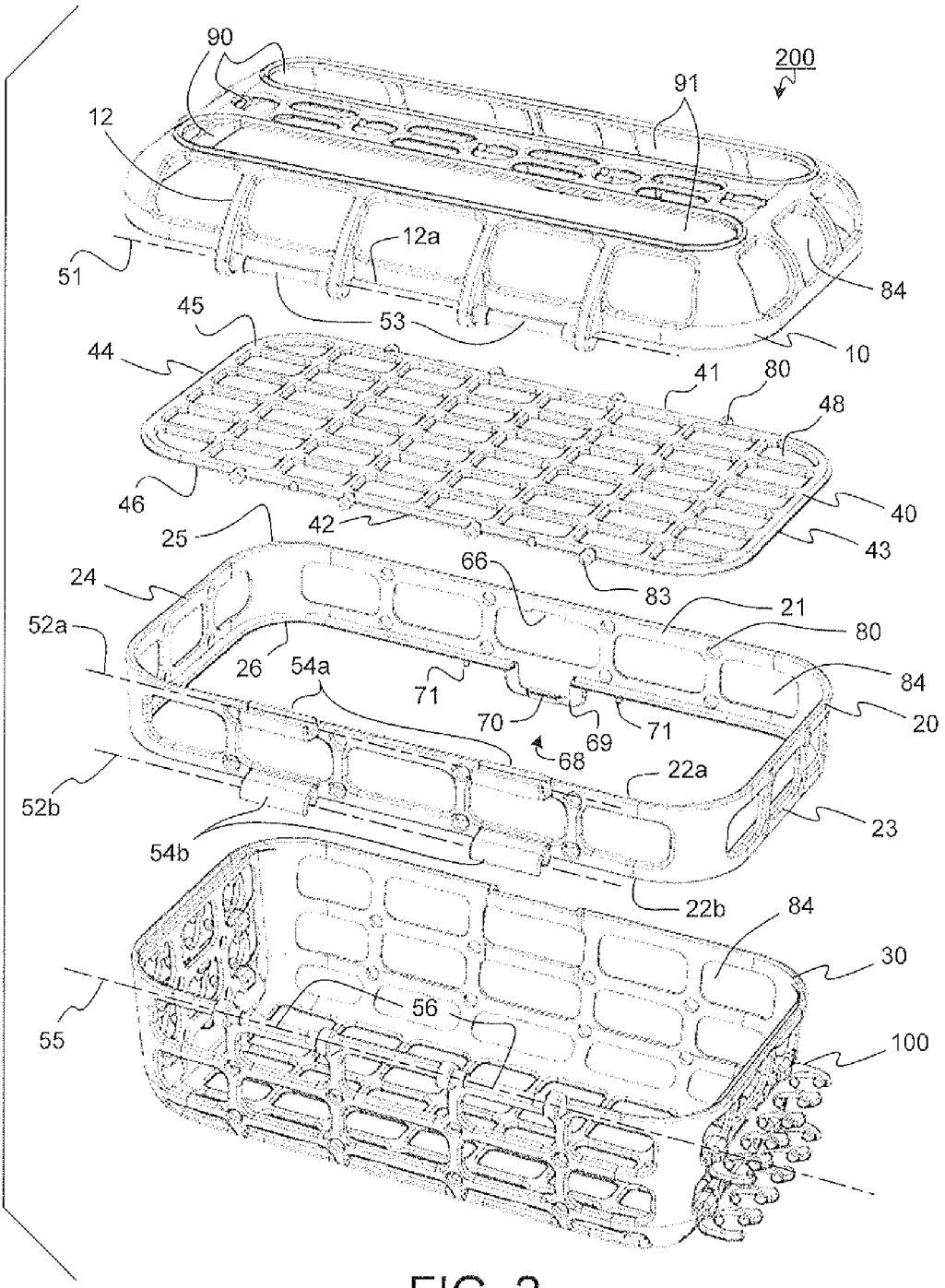
FIG. 2 shows a back perspective exploded view of the dishwasher basket.

As depicted in FIG. 2, the back face 12 of the lid 10 comprises a lid hinge 53, which is part of the connection assembly 50. The lid hinge 53 lies along a lid pivot axis 51 which runs substantially parallel to a bottom edge 12*a* of the back face 12.

Referring to FIG. 1, the container 30 has a U-shaped construction with various perforations 84 throughout. The container 30 has apertures 84, a front face 31, a back face 32, two side faces 33, 34, a top edge 35 and a bottom face 36. The container 30 comprises a container pivot axis 55 running substantially parallel to a top edge 35 of the back face 32. A container hinge 56 is disposed coincident and in alignment with the container pivot axis 55. The container 30 also has a frame engagement portion 72 along the top edge 35 of the front face 31.

When a bottom face 26 of the intermediate frame 20 lies flush against the top edge 31 of the container 30, such that the intermediate frame 20 is in a closed position relative to the container 30, the frame engagement portion 72 will come into contact with the frame locking member 68 on the intermediate frame 20.

The container 30 may include at least one straw holder 100. The straw holder 100 has at least one platform 102 having multiple retaining elements 104 adapted to receive and secure a portion of a drinking straw. The straw holder 100 has a holder pivot axis (B) upon which the platforms 102 may rotate in and out of a storage position. A second straw holder 100 with various multiple retaining elements 104 may be positioned near a first straw holder 100 to hold and secure the portion of the drinking straw by a friction fit grip.

As shown in FIG. 2, the intermediate frame 20 has a rectangular perforated frame shape. The intermediate frame 20 includes a front face 21, a back face 22, two side faces 23, 24, a top edge 25 and a bottom edge 26. The intermediate frame 20 also has a tray securing connection 80. The tray securing connection 80 includes a plurality of apertures or projections about the front 21, back 22, and side faces 23, 24. The intermediate frame 20 also comprises at least one frame pivot axis 52*a*, 52*b*.

The intermediate frame 20 has a first frame pivot axis 52*a* running substantially parallel and proximate to a top edge 22*a* of the back face 22 and a second frame pivot axis 52*b* running substantially parallel and proximate to a bottom edge 22*b* of the back face 22. Each pivot axis 52*a*, 52*b* has associated frame hinges 54*a*, 54*b*, which are part of the connection assembly 50.

The front face 21 of the intermediate frame 20 comprises a frame locking member 68, which is part of the locking system 60, having a downwardly projecting lip 69, an inward protrusion 70 projecting from the lip 69, and stoppers 71. The frame locking member 68 has a lid engagement portion 66 which comes into contact with the lid locking member 62 when the lid 10 is in a closed position.

The adjustment tray 40 is a flat perforated panel adapted to be positioned within the intermediate frame 20. The adjustment tray 40 has a front face 41, a back face 42, two side faces 43, 44, a top edge 45 and a bottom edge 46. The adjustment tray 40 further includes a plurality of protrusions (that extend from an edge thereof) or apertures 83 located along the front 41, back 42, or side faces 43, 44, which are part of the tray securing connection 80. The adjustment tray 40 may be solid or have a plurality of recesses or apertures 48 defined therein to allow a fluid to pass through the adjustment tray 40. The adjustment tray 40 may attach to different locations within the intermediate frame 20 to vary the height of the adjustment tray 40 and the volume of the upper compartment 18, as will be discussed in greater detail below.

Figure 7:
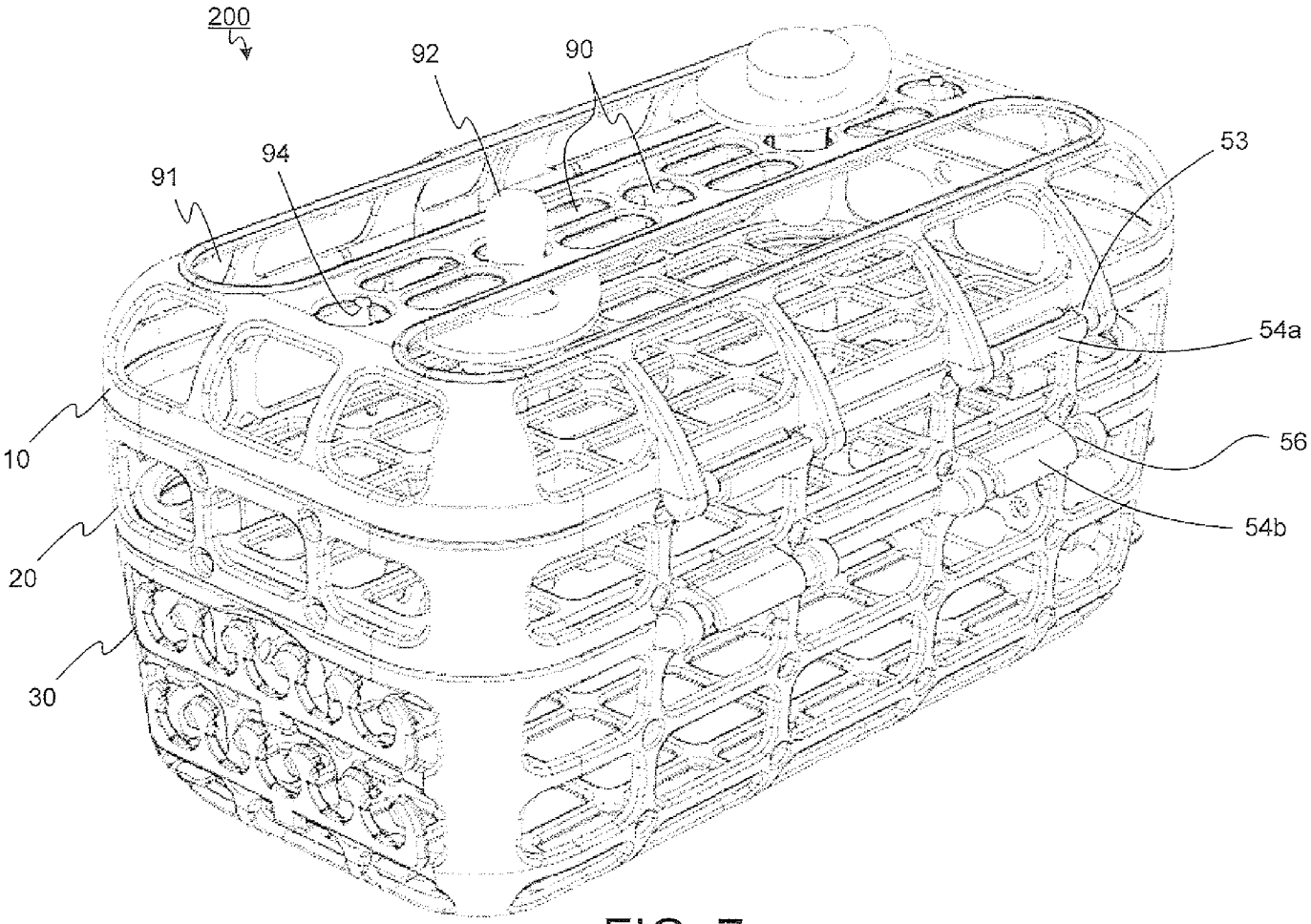
FIG. 7 illustrates a back perspective view of the dishwasher basket securing a variety of nipples.
Figure 8:
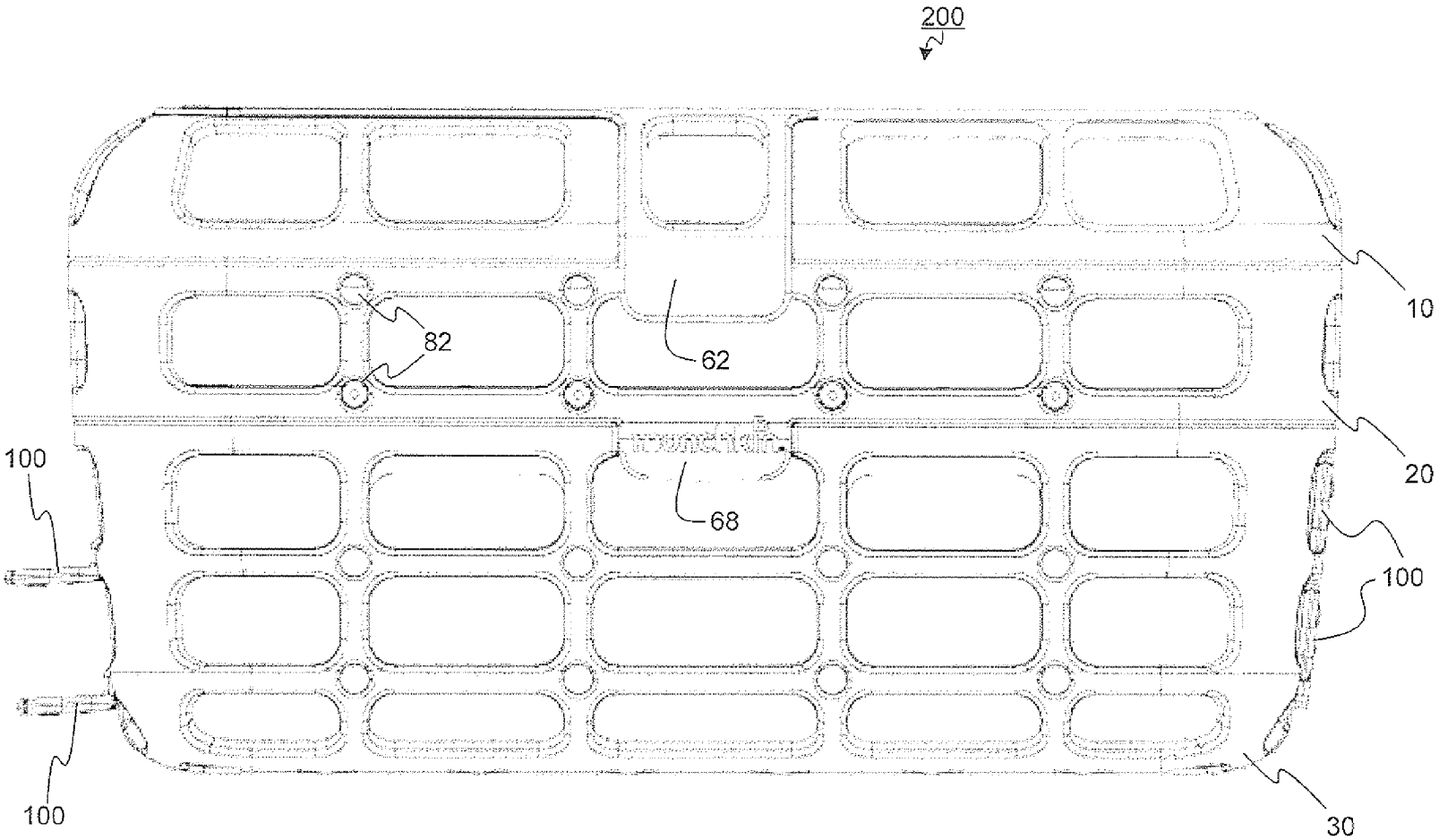
FIG. 8 illustrates a front view of the dishwasher basket.

The connection assembly 50 couples the container 30, the intermediate frame 20 and the lid 10 together. The connection assembly 50 includes the lid hinge 53, frame hinges 54*a*, 54*b* and the container hinge 56. As shown in FIG. 7, when assembled, the lid hinge 53 is received within an opening in the frame hinge 54*a* over which the frame hinge 54*a* rotates in a pivoting manner. Similarly, when assembled, the container hinge 56 is received within an opening in the frame hinge 54*b* over which the frame hinge 54*b* rotates in a pivoting manner. When the container 30, the intermediate frame 20 and the lid 10 are coupled together, the lid pivot axis 51 runs coincident to the first frame pivot axis 52*a* and the second frame pivot axis 52*b* runs coincident to the container pivot axis 55. In assembly, the relative rotation of the lid 10 to the intermediate frame 20 about pivot axis 51/52*a* is independent from the rotation of the intermediate frame 20 to the container 30 about pivot axis 52*b*/55.

The lid hinge 53, container hinge 56 and at least one frame hinge 54*a*, 54*b* may be constructed of a cylindrical protruding portion and a receiving portion respectively. The protruding and receiving portion of a hinge can be located on either side of the hinge connection. The protruding and receiving portion may be adapted to be removably snap-fit together, such that the user may easily separate the lid 10, intermediate frame 20 or container 30 if necessary. The connection assembly 50 may also use other hinge mechanisms to facilitate the independent opening and closing of the lid 10, intermediate frame 20 and container 30.

Figure 3:
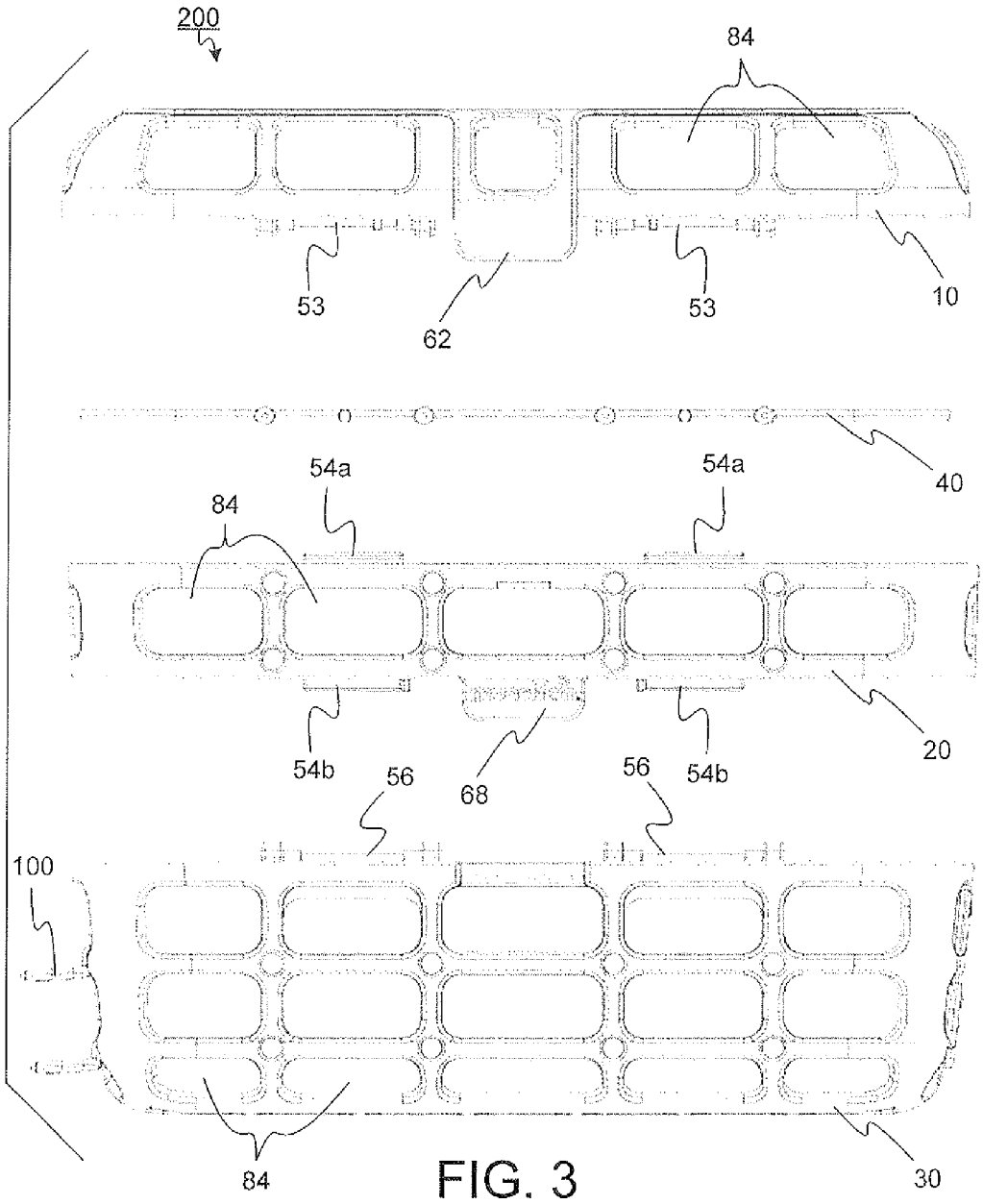
FIG. 3 shows a front exploded view of the dishwasher basket.
Figure 4:
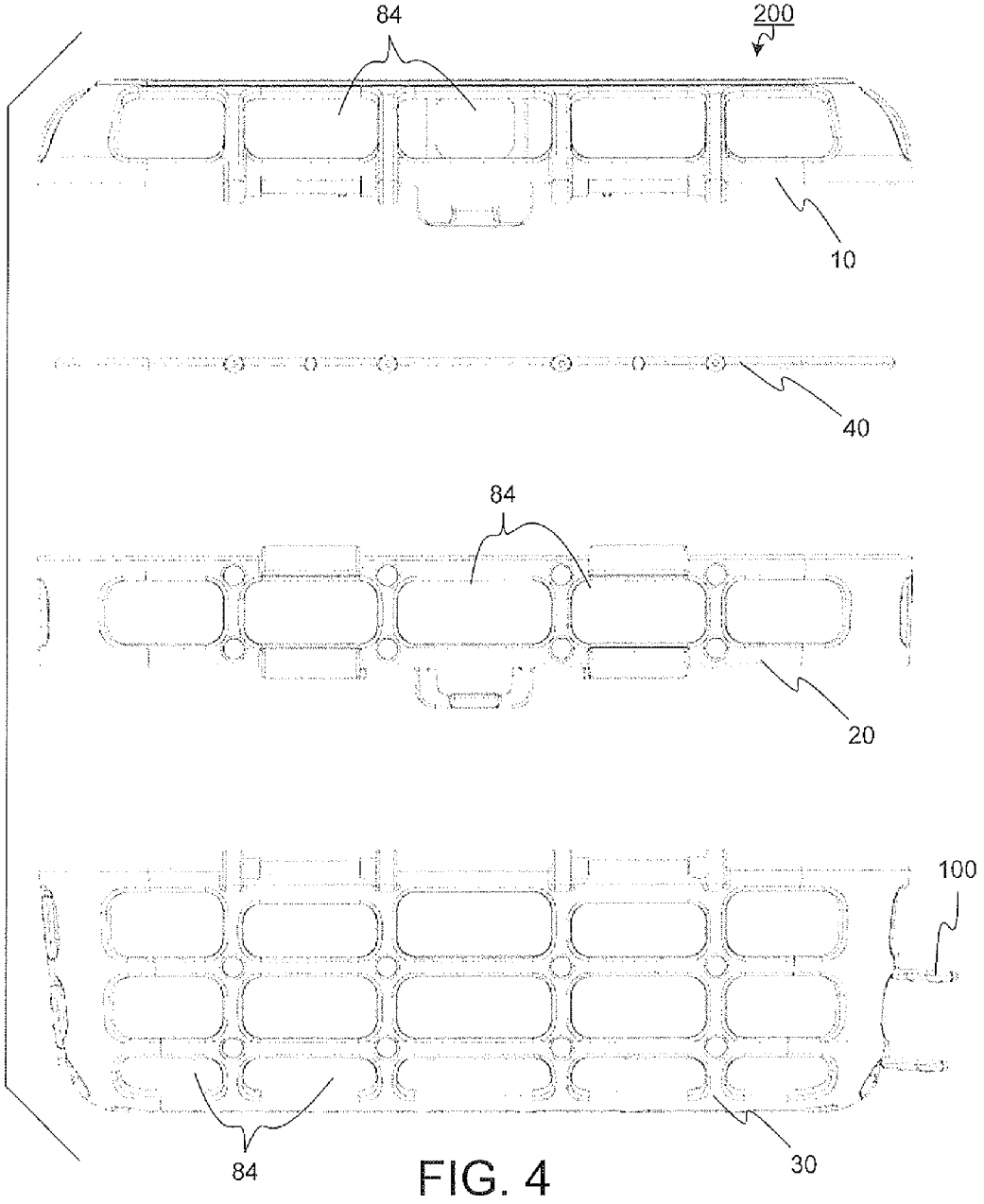
FIG. 4 shows a back exploded view of the dishwasher basket.

FIGS. 3-4 show front and back views respectively of the dishwasher basket 200. The dishwasher basket 200 may have rounded edges around a periphery of the top face 15 of the lid 10 or bottom face 36 of the container 30. Furthermore, the intermediate frame 20 may have rounded edges around a periphery of its rectangular shape, which may match the rounded edges of the adjustment tray 40.

Figure 13:
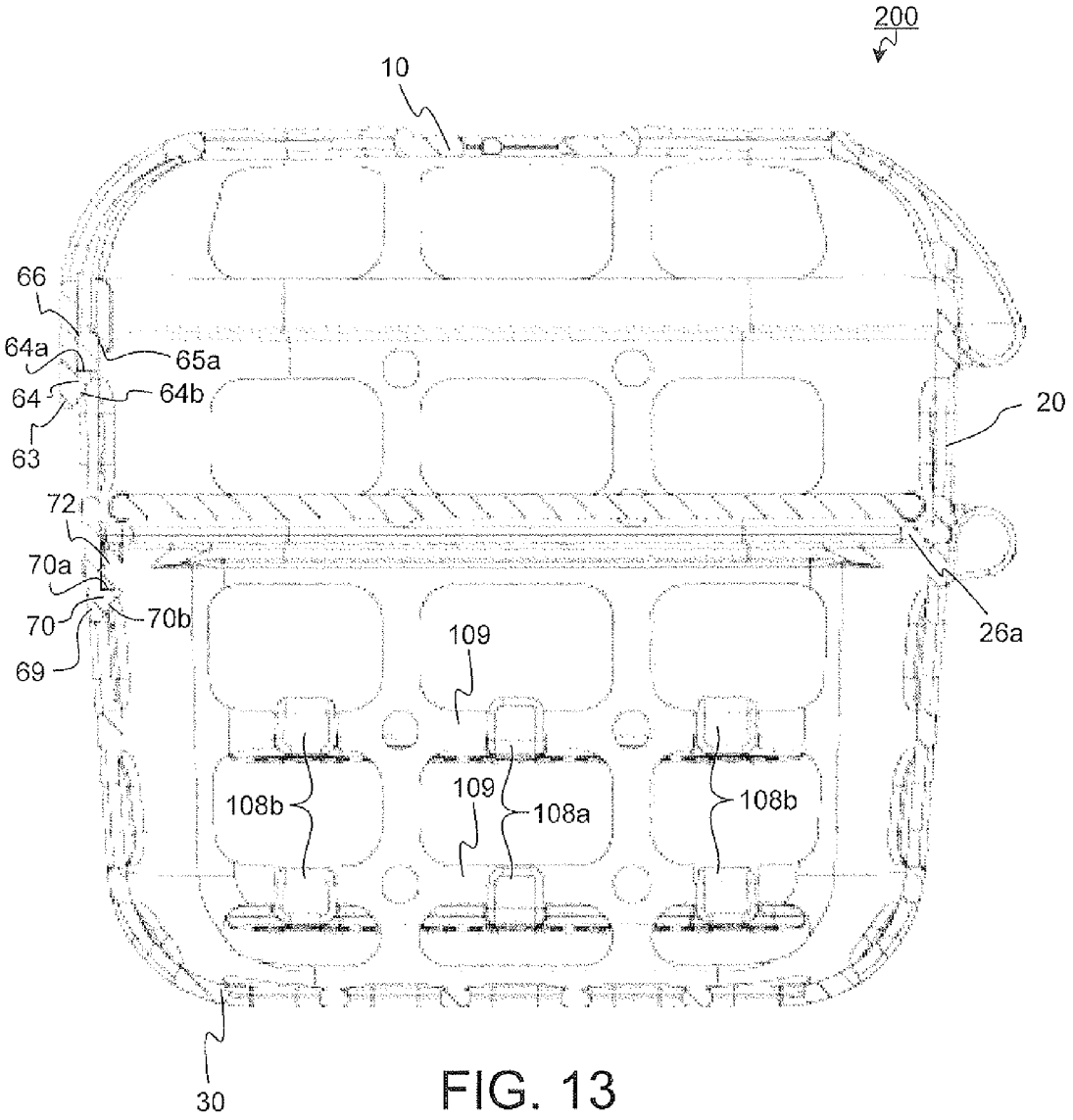
FIG. 13 shows a cross section view of the dishwasher basket about B-B in FIG. 10.

FIG. 5 depicts a side view of the exploded dishwasher basket 200. The locking system 60 is shown in greater detail, as shown in FIGS. 5 and 13. Both inward protrusions 64, 70 may have a top platform 64*a*, 70*a* which extends away from the downwardly projecting lip 63, 69 respectively. As shown in FIG. 13, an angled surface 64*b*, 70*b* tapers down from the top platform 64*a*, 70*a* towards a bottom edge of the downwardly projecting lip 63, 69.

When the lid 10 moves from an open position to a closed position, the inward protrusion 64 will be biased away from the lid engagement portion 66 on the intermediate frame 20. The downwardly projecting lip 63 will then be deflected and biased away from the intermediate frame 20 as the lid engagement portion 66 slides over the angled surface 64*b* of the inward protrusion 64. When the bottom of the lid engagement portion 66 reaches the top platform 64*a* of the inward protrusion 64, the downwardly projecting lip 63 will snap back or return to its unbiased position, thereby locking the lid 10 to the intermediate frame 20.

The frame locking member 68 may function in a similar way to the lid locking member 62. When the intermediate frame 20 moves from an open position to a closed position, the inward protrusion 70 will be biased away from the frame engagement portion 72 on the container 30. The downwardly projecting lip 69 will then be deflected and biased away from the container 30 as the frame engagement portion 72 slides over the angled surface 70*b* of the inward protrusion 70. When the bottom of the frame engagement portion 72 reaches the top platform 70*a* of the inward protrusion 70, the downwardly projecting lip 69 will snap back or return to its unbiased position, thereby locking the intermediate frame 20 to the container 30.

The stoppers 65 of the lid locking member 62 may also have an angled surface 65*a* facing towards the front of the dishwasher basket 200. The angled surface 65*a* facilitates opening the lid 10 from a closed position. When the lid engagement portion 66 of the intermediate frame 20 is pushed towards the stopper 65, the stopper 65 will deflect upward and bias the lid 10 towards an open position. When the lid engagement portion 66 clears the top platform 64*a* of the inward protrusion 64, the lid 10 will rotate into the open position due to the bias of the stopper 65.

The stoppers 71 of the frame locking member 68 may also have an angled surface 71*a* facing towards the front of the dishwasher basket 200. The angled surface 71*a* facilitates opening the intermediate frame 20 from a closed position. When the frame engagement portion 72 of the container 30 is pushed towards the stopper 71, the stopper 71 will deflect upward and bias the intermediate frame 20 towards an open position. When the frame engagement portion 72 clears the top platform 70*a* of the inward protrusion 70, the intermediate frame 20 will rotate into the open position due to the bias of the stopper 71.

FIG. 6 depicts a front perspective view of a user loading a nipple 92 through a nipple slot 91 into the dishwasher basket 200. As shown, an advantage of this subject disclosure is to be able to place the nipple 92 into an upper compartment 18 of the dishwasher basket 200 through the slot 91 without opening the lid 10 and be secured by the elongated slot 91. In this way, the pre-positioned nipples 92 are not disturbed in their storage position within the dishwasher basket 200. Alternatively, the lid 10 may be opened relative to the intermediate frame 20, and the user may load various nipples 92 into the upper compartment 18, and then close the lid 10.

FIG. 7 illustrates a back perspective view of the dishwasher basket 200 securing various items, such as nipples and pacifiers. Different sized slots 90 disposed within the lid 10 may hold a portion of a variety of different sized nipples or other obtuse items. For example, pacifiers may have a circular connection between a base and the nipple portion, or the connection may be elliptical or other odd configuration. The different sized slots 90 in the lid 10 are adapted to accommodate the varying configurations of pacifiers and other items. The slots 90 may also be adapted to receive other small articles such as straws, valves, discs, etc.

Figure 16:
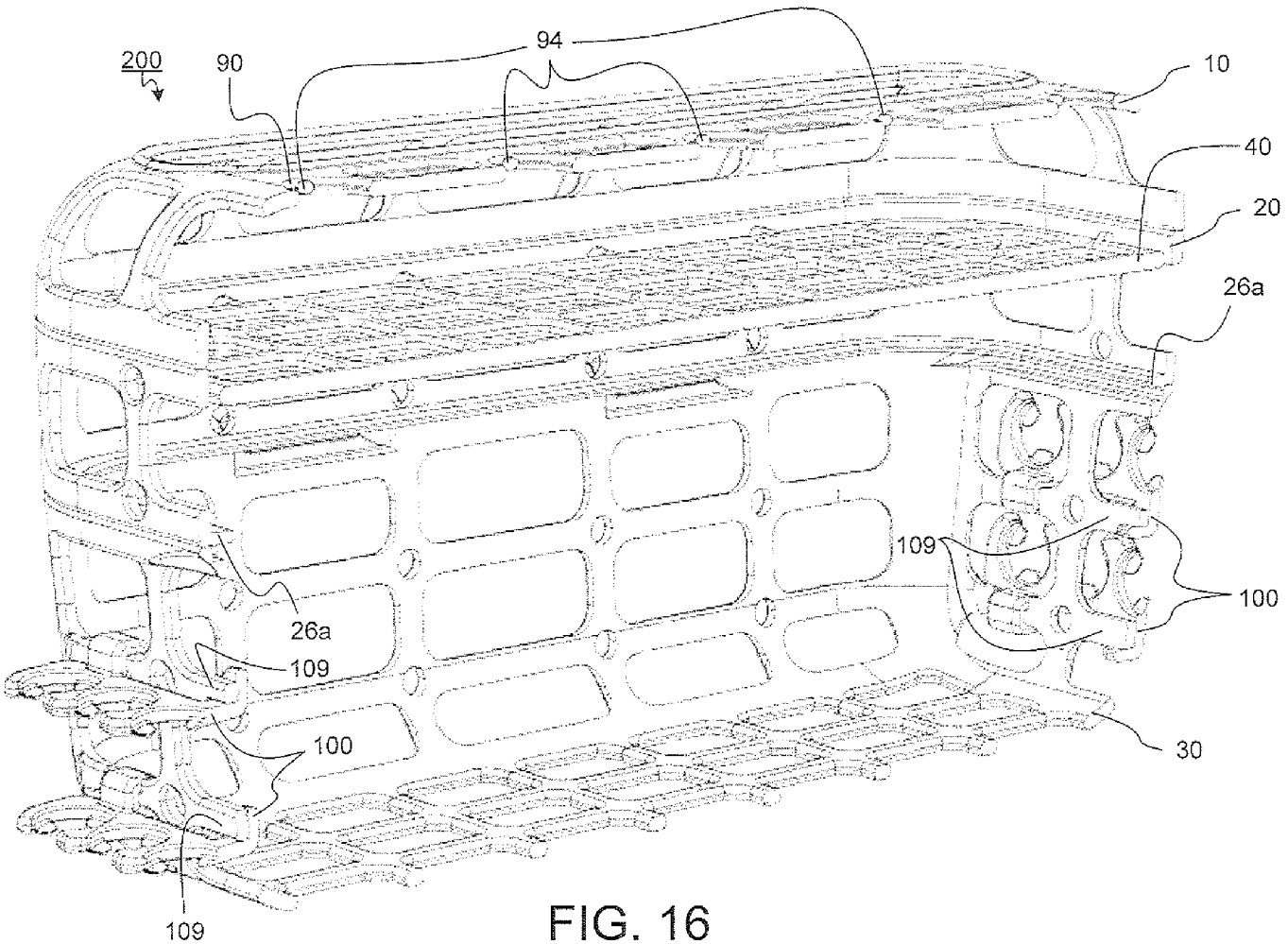
FIG. 16 shows a perspective cross section view of the dishwasher basket about D-D in FIG. 10.
Figure 17:
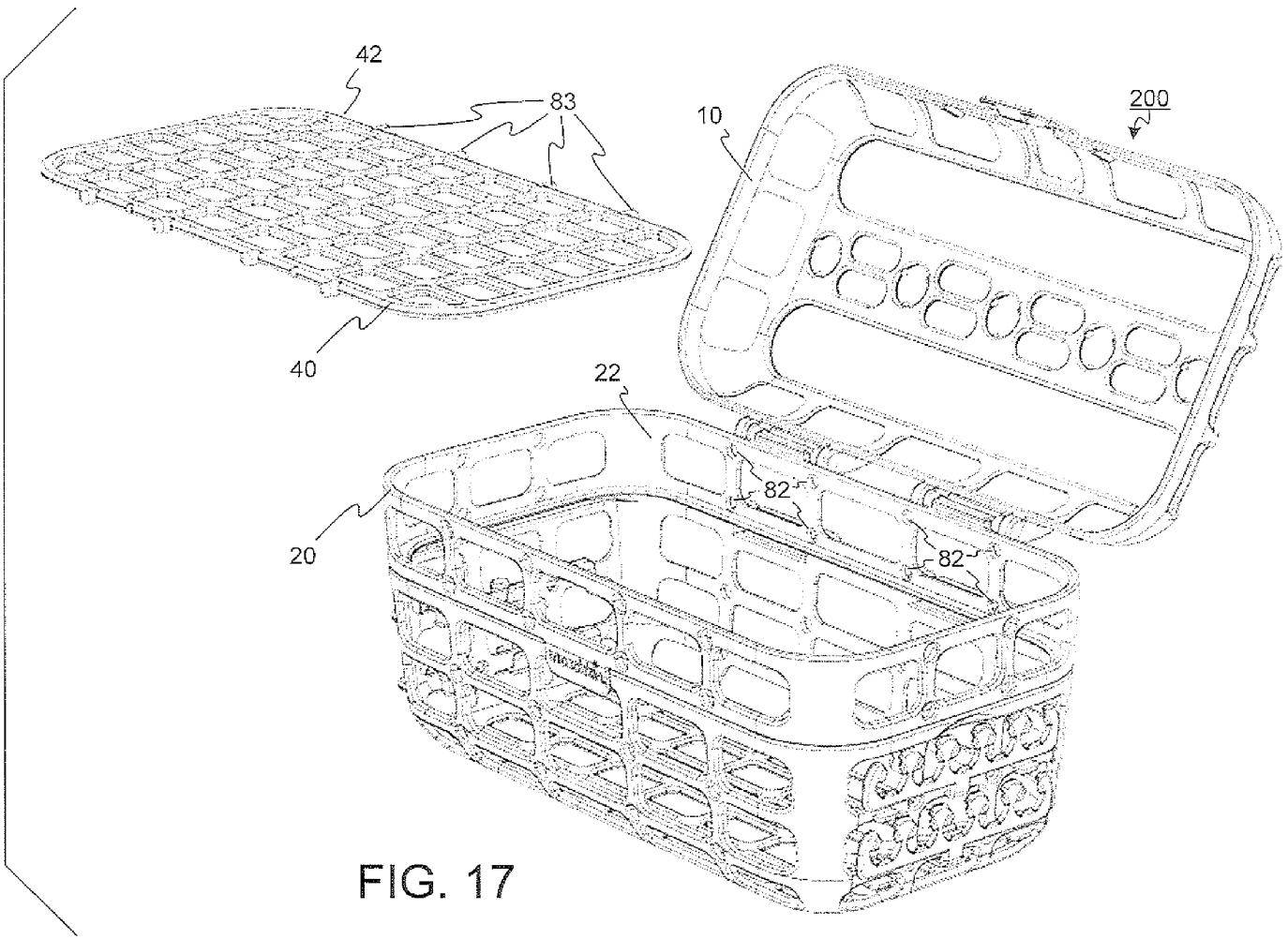
FIG. 17 depicts the adjustment tray separate from the dishwasher basket.

The slots 90 may also have projecting ribs 94 to further secure the gripped nipple 92 (also depicted in greater detail in FIG. 16). The projecting ribs 94 slightly deform the nipple 92 and increase the frictional forces between the slot 90 and outer surface of the nipple 92. There may be multiple ribs 94 per slot 90 and may be placed in varied configurations.

FIGS. 8-11 illustrate various plan views of the dishwasher basket 200 with the lid 10 and intermediate frame 20 in a closed position.

Figure 9:
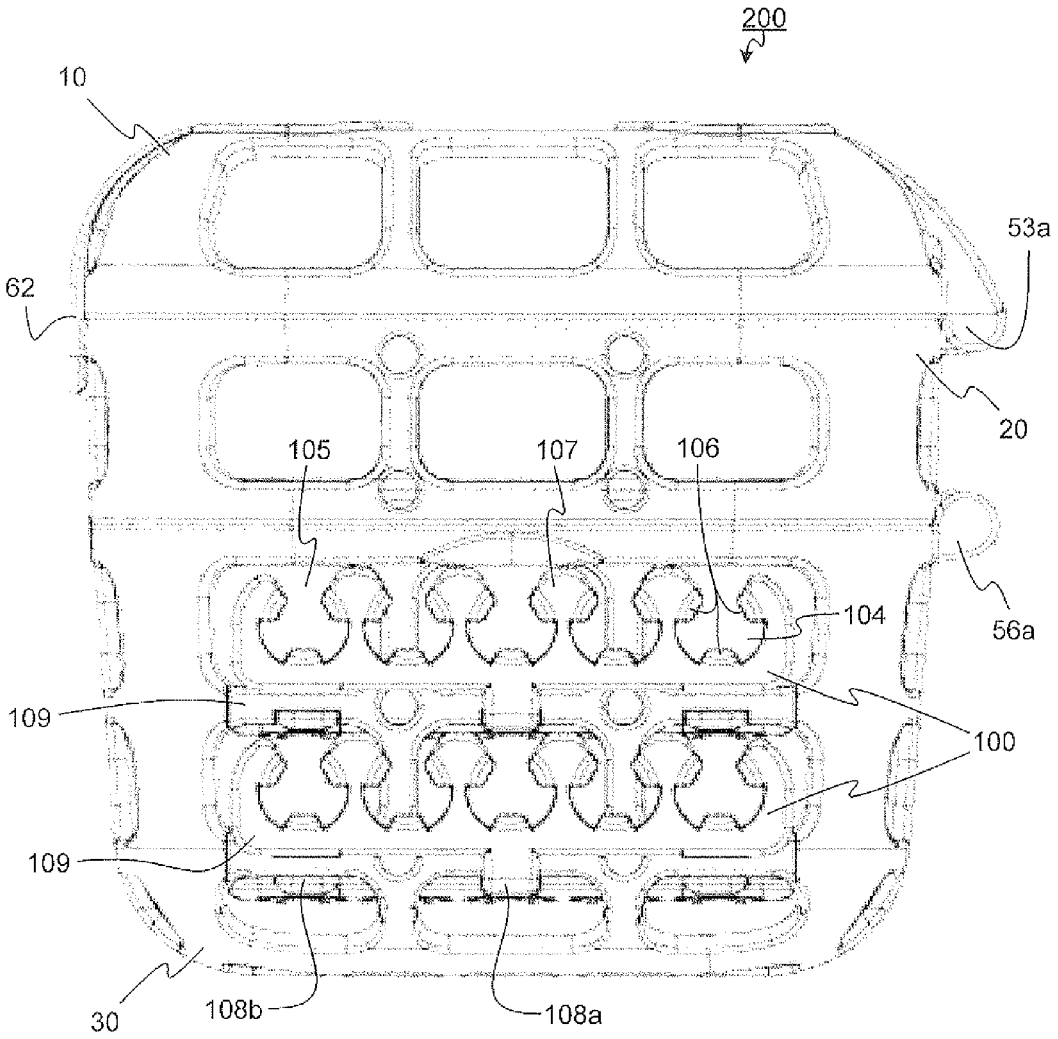
FIG. 9 illustrates a side view of the dishwasher basket.

FIG. 9 shows the straw holder 100 in greater detail. The straw holder 100 may be constructed to have multiple retaining elements 104. Each retaining element 104 is adapted to receive and secure a portion of a straw when the straw holder 100 is in an open position, like the position of the straw holder 100 as shown in FIG. 2. The straw may pass vertically pass through one or more straw holders 100, slightly deflecting the retaining elements 104 to retain and secure the straw. However, the straw holder 100 may also receive straws in the closed position as shown in FIG. 9, in which case the straw would be horizontally received and secured by the retaining elements 104.

Figure 12:
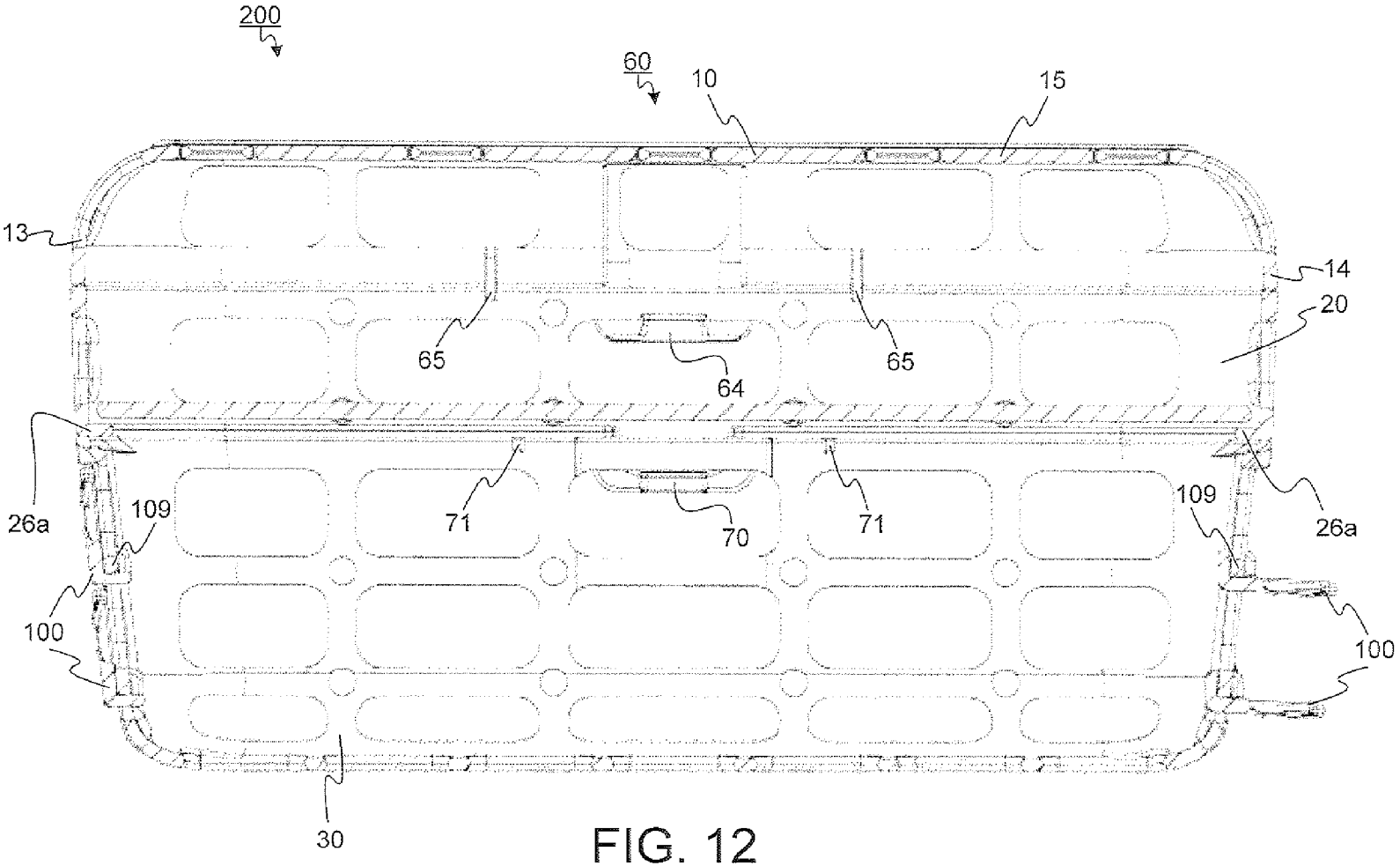
FIG. 12 shows a cross section view of the dishwasher basket about A-A in FIG. 10.

The straw holder 100 may have straw hinge members 108*a*, 108*b* which grip onto a portion 109 of the container 30. As shown in FIGS. 12, 13 and 16, as depicted by the straw holder 100 in both the open and closed positions, the straw holder 100 may pivot about the portion 109 of the container 30. Straw hinge member 108*a* grips the opposite side of the portion 109 of the container 30 than the straw hinge member 108*b*, as shown in FIG. 13. Together the hinge members 108*a*, 108*b* allow the straw holder 100 to rotate between the open and closed positions.

Each retaining aperture 104 may have at least one flexible tab 106. As the straw is secured within the retaining aperture 104, the flexible tabs 106 may deflect against the straw to guide and retain the straw. The straw holder 100 may also be constructed as a series of mushroom-shaped projections 107 which are separated by spaces 105 into which the straw may be inserted.

A first method of inserting the straw into the straw holder 100 is to push an end of the straw orthogonally through the straw aperture 104. Another method of inserting the straw is to push a side of the straw into the space 105, deflecting the straw and/or mushroom-shaped projections 107 away from the straw until it slides into the straw aperture 104.

Figure 10:
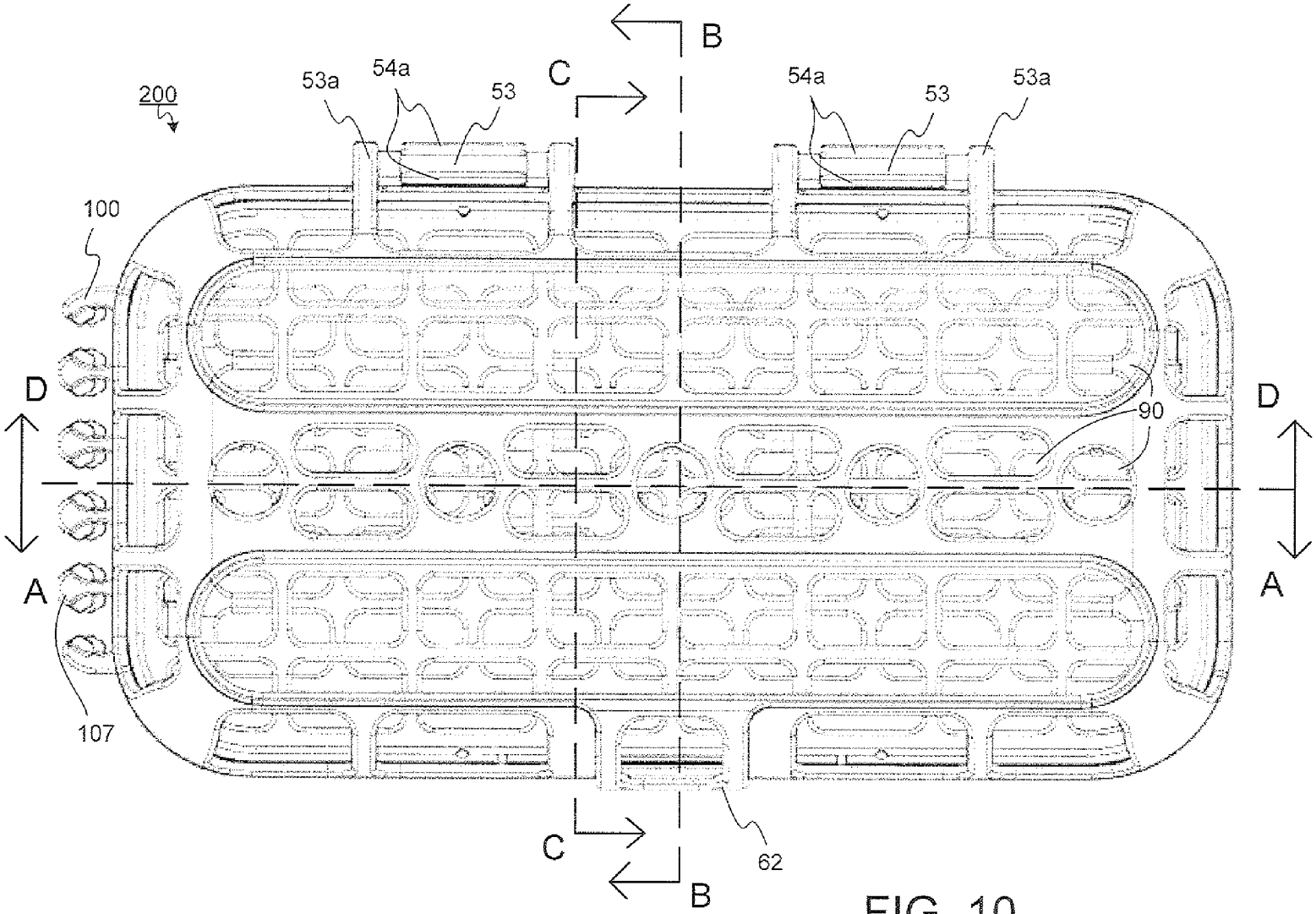
FIG. 10 illustrates a top view of the dishwasher basket.

Top view FIG. 10 depicts the connection between the lid 10 and intermediate frame 20 in greater detail. As shown, the lid hinge 53 may be in the form of a shaft which is grasped by the frame hinge 54*a*. The lid hinge 53 may have two lobes 53*a* which cap the shaft at a first and second end thereof and facilitate the alignment of the frame hinge 54*a* during installation. The frame hinge 54*a* is a partial C-shaped cylinder with an inner diameter that is approximately equivalent to the outer diameter of the lid hinge 53. During installation, the lid hinge 53 is pushed into the frame hinge 54*a*, deflecting the cylinder until the container hinge 53 snap-fits into place over the frame hinge 54*a*. This provides a pivotal connection between the lid 10 and intermediate frame 20. The lid 10 is then easily separable from the intermediate frame 20 by disengaging the snap-fit connection between the lid hinge 53 and frame hinge 54*a* for storage or the like.

Figure 11:
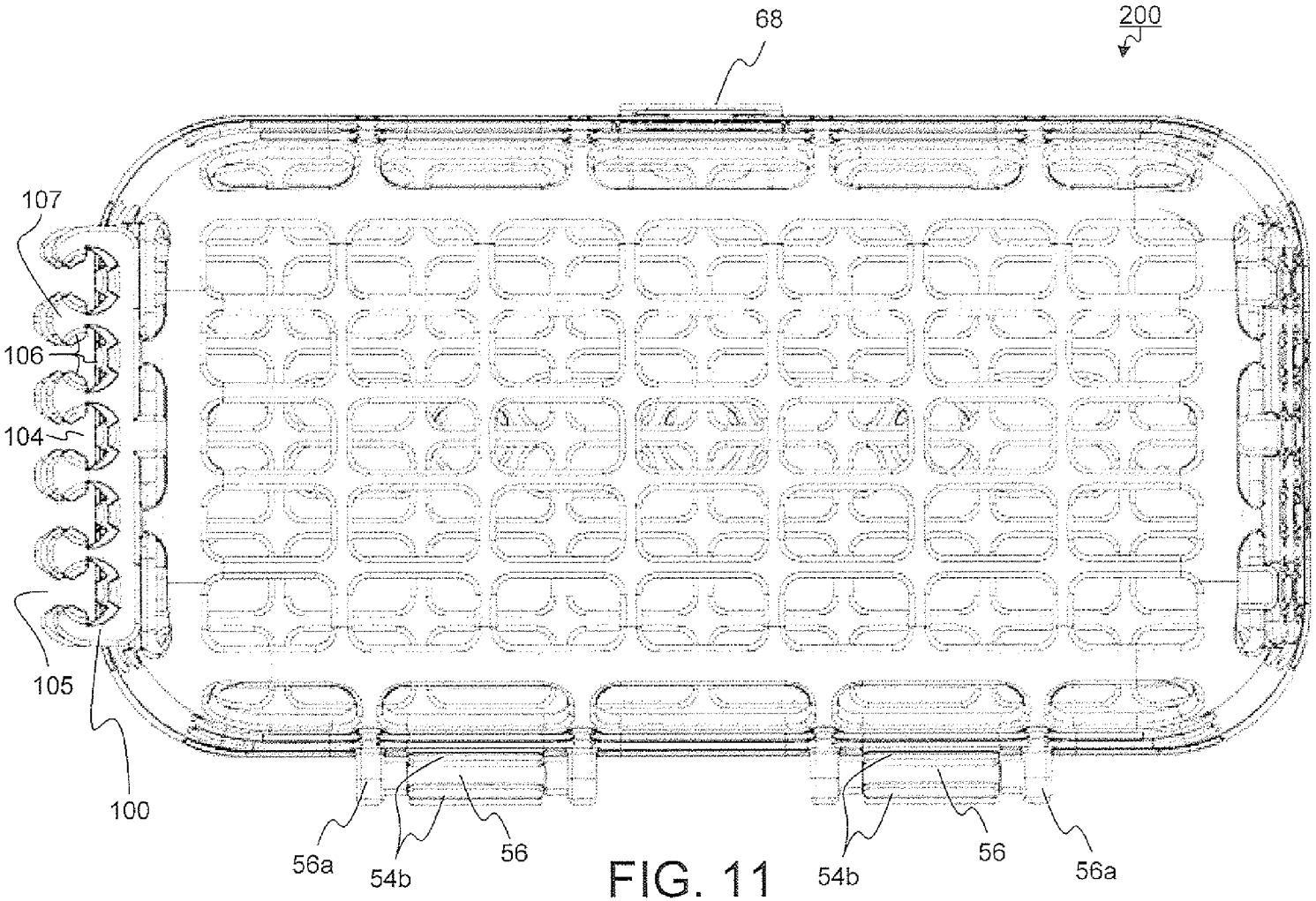
FIG. 11 illustrates a bottom view of the dishwasher basket.

Bottom view FIG. 11 shows the connection between the container 30 and intermediate frame 20 in greater detail. As shown, the container hinge 56 may be in the form of a shaft which is grasped by the frame hinge 54*b*. The container hinge 56 may have two lobes 56*a* which cap the shaft at a first and second end thereof and facilitate the alignment of the frame hinge 54*b* during installation. The frame hinge 54*b* is a partial C-shaped cylinder with an inner diameter that is approximately equivalent to the outer diameter of the container hinge 56. During installation, the container hinge 56 is pushed into the frame hinge 54*b*, deflecting the cylinder until the container hinge 56 snap-fits into place over the frame hinge 54*b*. This provides a pivotal connection between the container 30 and intermediate frame 20. The container 30 is then easily separable from the intermediate frame 20 by disengaging the snap-fit connection between the container hinge 56 and frame hinge 54*b* for storage or the like.

FIGS. 12-16 show various cross section views of the dishwasher basket 200 about section lines in FIG. 10. FIG. 12 depicts the locking system 60 showing the lid 10 and intermediate frame 20 in the closed position. As shown, the stoppers 65 descend past the top face 25 of the intermediate frame 20 and the stoppers 71 descend past the top face 35 of the container 30.

FIG. 13 shows a cross-section view of the locking system 60. As shown, the lid engagement portion 66 of the intermediate frame 20 is gripped on either side by the downwardly projecting lip 63, top platform 64*a* and angled surface 65*a* of the stopper 65. Similarly, the frame engagement portion 72 of the container 30 is gripped on either side by the downwardly projecting lip 69, top platform 70*a* and angled surface 71*a* of the stopper 71 (stopper 71 not shown in this cross-section).

FIG. 13 also shows the intermediate frame 20 may have a bottom ledge 26*a* (as also depicted in FIGS. 12 and 14-16). The bottom ledge 26*a* projects towards an inner volume of the intermediate frame 20 and may encircle a perimeter of the bottom edge 26 as to support and prevent the adjustment tray 40 from slipping into the container 30. The front 41, back 42 and side 43, 44 faces of the adjustment tray 40 may rest against the bottom ledge 26*a* when installed in the position as depicted in FIG. 13. However, it is to be understood that the adjustment tray 40 may be sufficiently received and secured by the intermediate frame 20 by use of the apertures 82.

Figure 14:
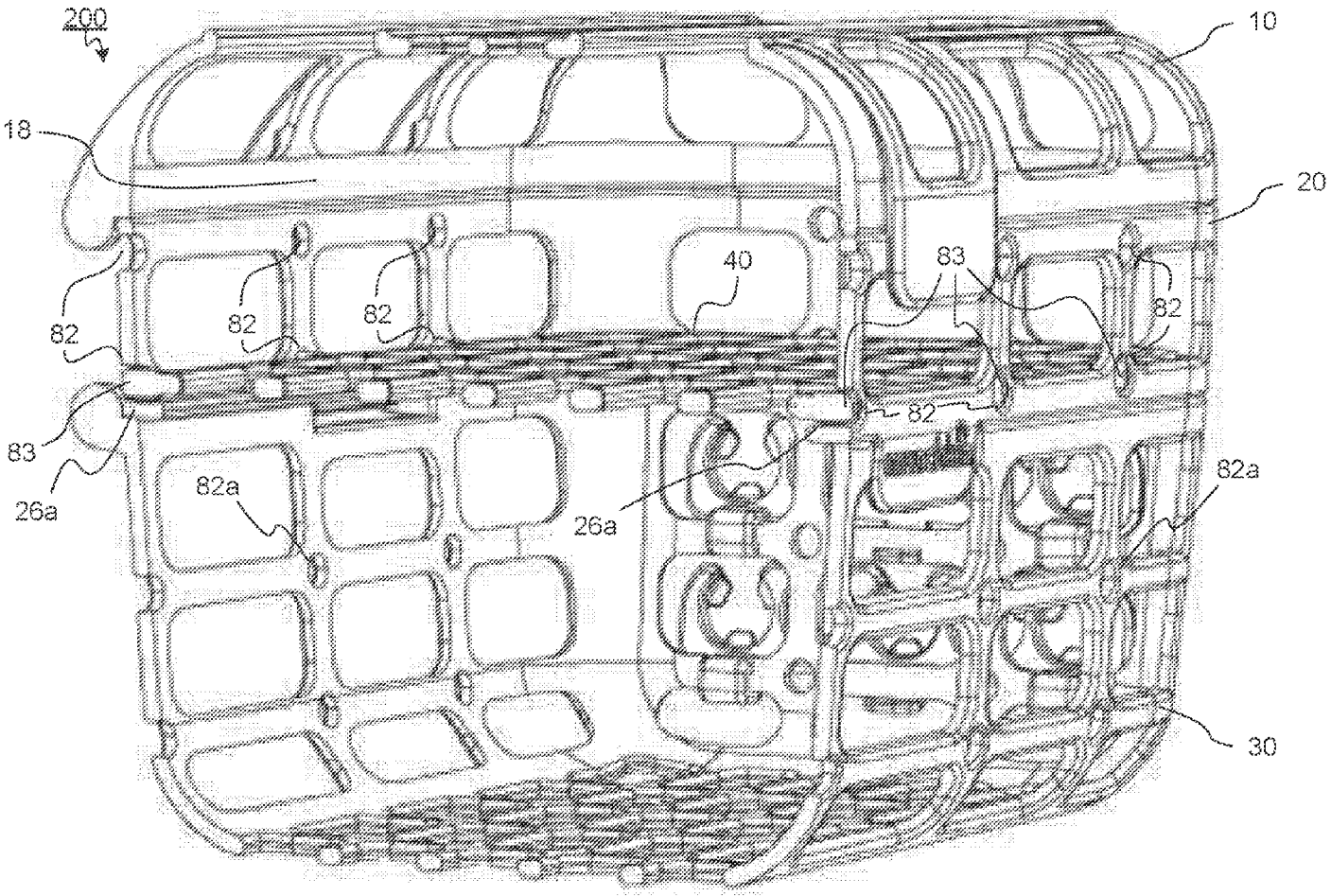
FIG. 14 shows a perspective cross section view of the dishwasher basket about C-C in FIG. 10.
Figure 15:
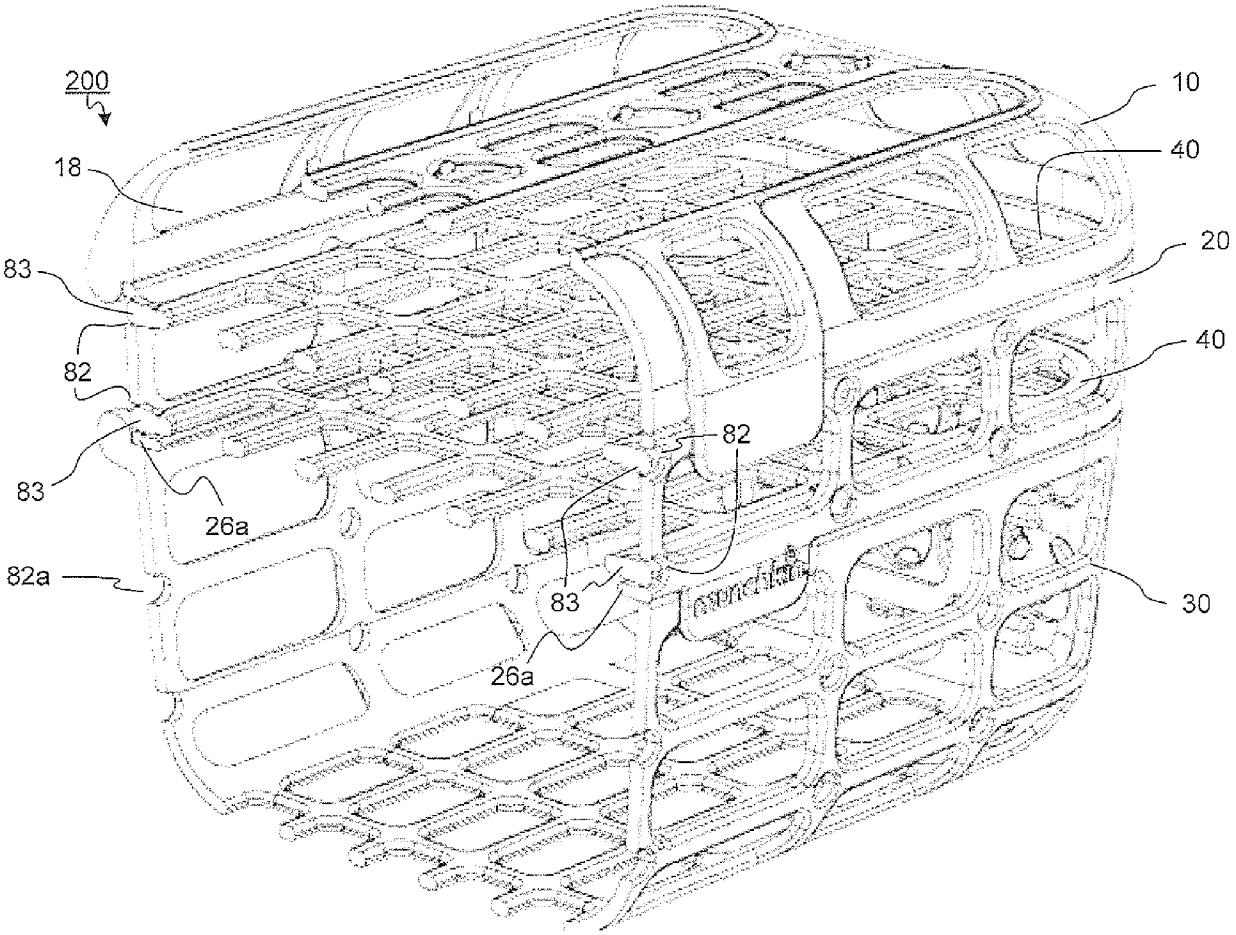
FIG. 15 shows another perspective cross section view of the dishwasher basket about C-C in FIG. 10.

FIGS. 14-15 show a cross section view of the adjustment tray 40 in multiple configurations. FIG. 14 depicts the adjustment tray 40 in a first position. As shown, protrusions 83 on the adjustment tray 40 are received by apertures 82 disposed along the bottom edge of the front 21 and back 22 faces of the intermediate frame 20. It is to be understood that these apertures 82 may be disposed on the adjustment tray 40 and the protrusions 83 on the intermediate frame 20, either on the front 21, back 22 or side 23, 24 faces of the intermediate frame 20. As depicted, apertures 82 lie within horizontal planes which, when the adjustment tray 40 is installed, are coincident with the adjustment tray 40.

FIG. 15 depicts the adjustment tray 40 in the first and a second position. Having multiple adjustment trays 40 and multiple positions in which they may be secured into the dishwasher basket 200 allows for numerous configurations for holding small, loose items during wash. For instance, the configuration as shown in FIG. 15 may hold smaller sized nipples and pacifiers in the upper compartment 18, as well as a number of smaller items in between the adjustment trays 40. The adjustment tray is shown in the second position alone in FIG. 16

In addition, an advantage of having the lid 10 rotate and open with respect to the intermediate frame 20 independently from the intermediate frame 20 rotating and opening with respect to the container 30 is that the user may access items stored in a compartment within the container 30 and the intermediate frame 20 without disturbing items located in the compartment between the lid 10 and intermediate frame 20 respectively.

Furthermore, several similar apertures 82*a* may also be located on various other parts of the dishwasher basket 200, such as the container 30 or lid 10. The adjustment tray 40 may also be placed such that protrusions 83 are received and secured by these apertures 82*a*. The adjustment tray 40 may also be configured to be installed vertically, as opposed to horizontally as shown in FIGS. 14-15, to form various separate compartments within the container 30, intermediate frame 20 or lid 10.

FIGS. 17-22 illustrate the method of inserting the adjustment tray 40 into the dishwasher basket 200.

Figure 18:
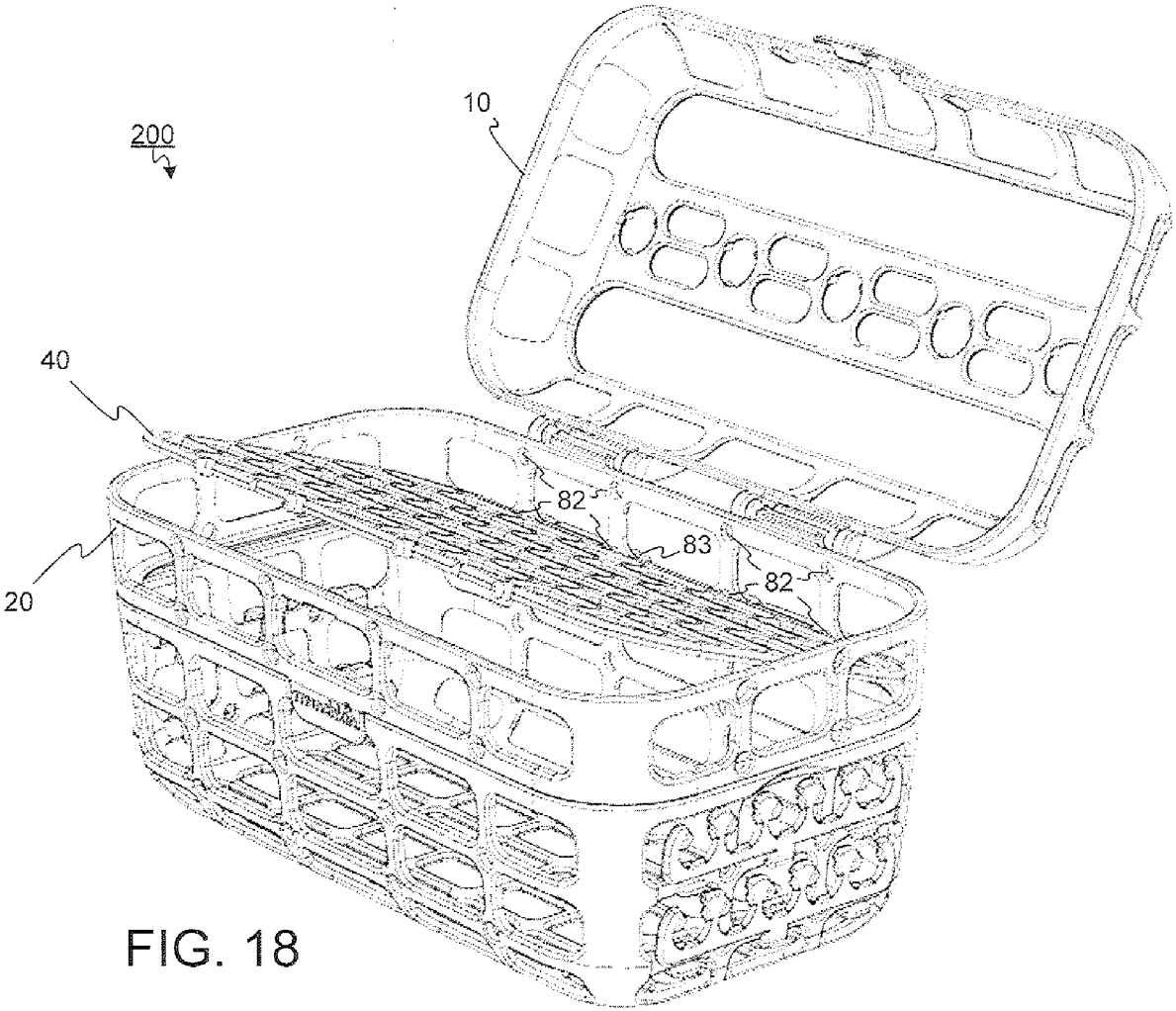
FIG. 18 illustrates the first step in inserting the adjustment tray.
Figure 21:
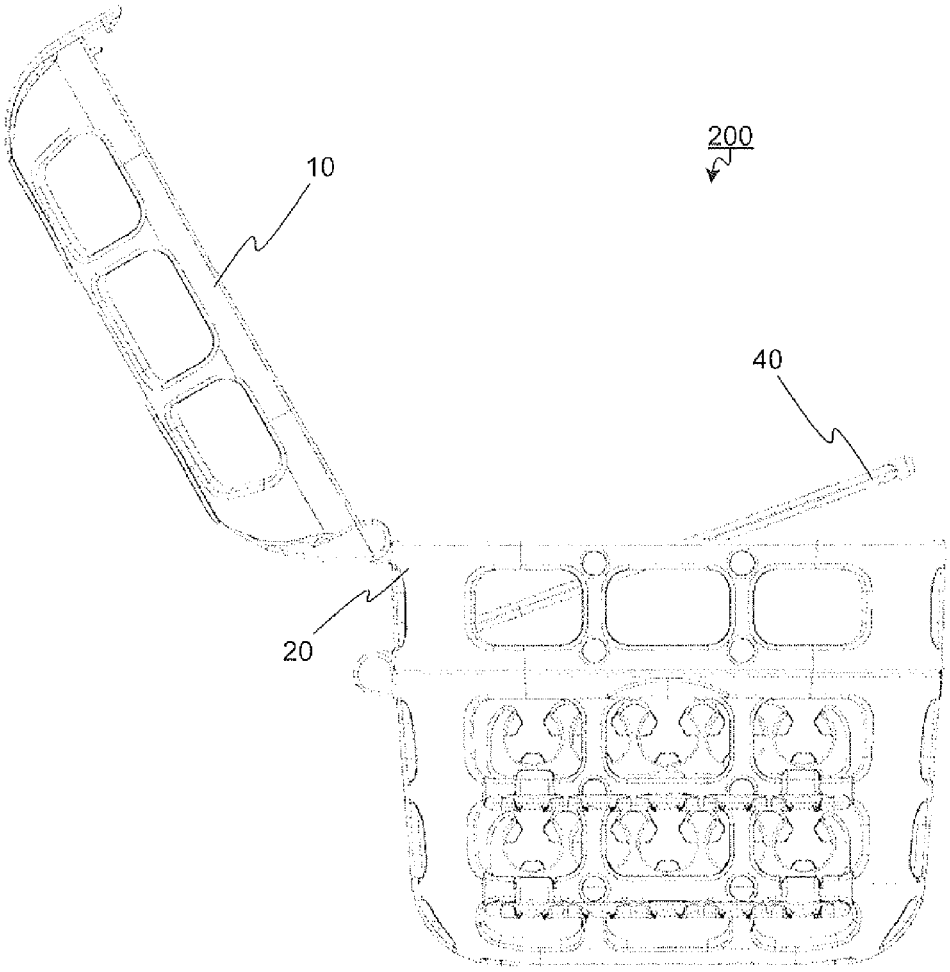
FIG. 21 shows a side view of the second step in inserting the adjustment tray.
Figure 22:
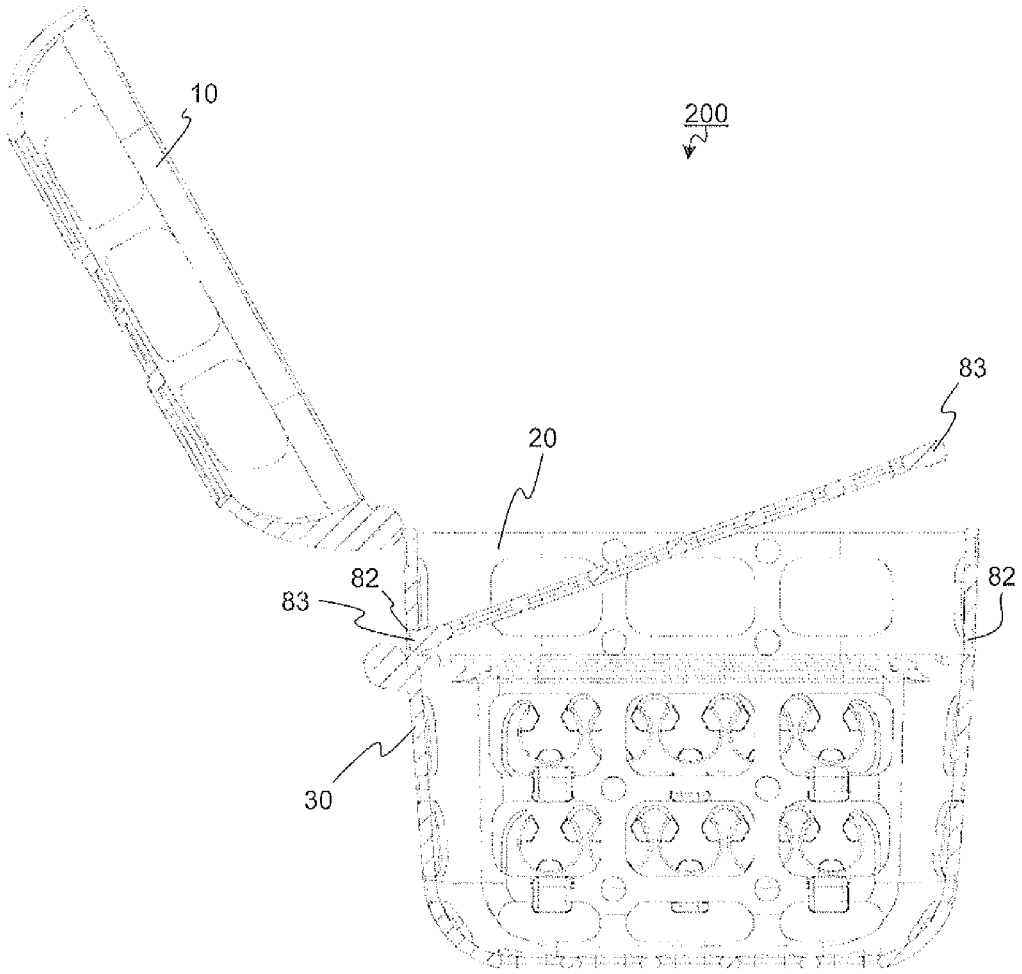
FIG. 22 shows a cross section view of the second step in inserting the adjustment tray.

In a first step, the plurality of apertures 82 located on the back face 22 of the intermediate frame 20 receive the plurality of protrusions 83 located on the back face 42 of the adjustment tray 40, as shown in FIGS. 18 and 21 and the cross section view in FIG. 22.

Figure 19:
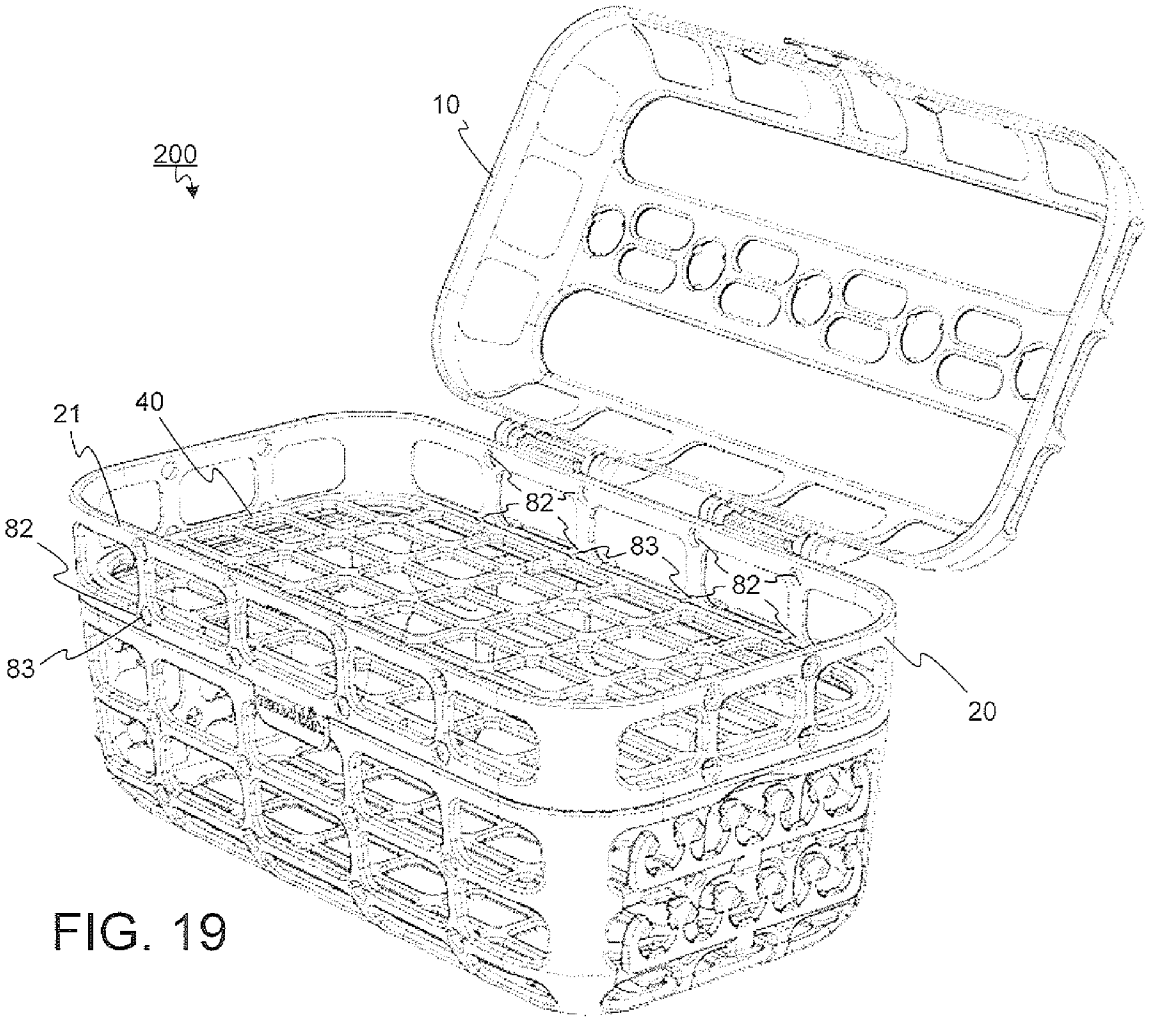
FIG. 19 illustrates the second step in inserting the adjustment tray.

In a second step, when the adjustment tray 40 is lowered into a first position, the apertures 82 on the front face 21 of the intermediate frame 20 will receive the protrusions 83 on the front face 41 of the adjustment tray 40, as shown in FIG. 19. In the second step, the intermediate frame 20 must slightly flex in order for the protrusions 83 to clear the front face 21 of the intermediate frame 20. When the protrusions 83 are significantly aligned with the apertures 82, the intermediate frame 20 will flex back into its original state.

Figure 20:
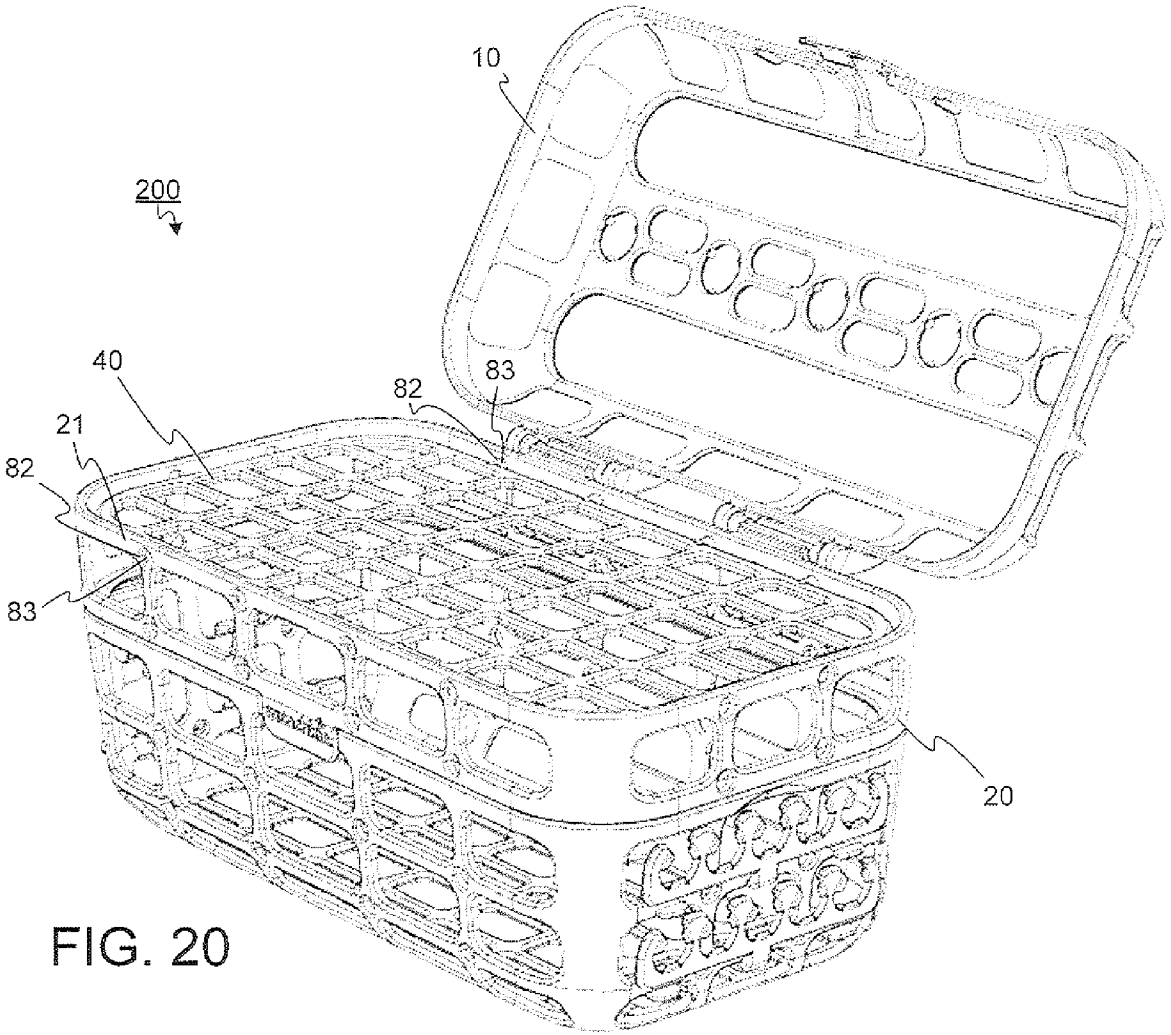
FIG. 20 illustrates the adjustment tray in a secondary position.

In a third step, the adjustment tray 40 may also be placed in a second position, thereby altering the height of the adjustment tray 40 relative to the intermediate frame 20 and altering a volume of the upper compartment 18, as shown in FIG. 20. The adjustment tray 40 may be removed from its first position as shown in FIG. 19 by slightly flexing the intermediate frame 20 to increase the space between the front face 21 and back face 22 and pulling up on the adjustment tray 40 to dislodge the protrusions 83 from the apertures 82. Then, the adjustment tray 40 may be placed in the second position using steps one and two using different configurations of apertures 82. The tray securing connection 80 may also encompass more than two positions.

Referring back to FIGS. 6-7, by altering the height of the adjustment tray 40, a user may secure different sized nipples 92. FIG. 6 shows the upper compartment 18 housing large nipples 92 meant for larger bottles, with the adjustment tray 40 in the first position. FIG. 7 shows the upper compartment 18 containing smaller nipples and/or pacifiers 92 which would allow the adjustment tray 40 to be in the second position. By minimizing the volume of the upper compartment 18, the dishwasher basket 200 will minimize the movement of the smaller articles placed therein.

As employed in this specification and annexed drawings, the term "or" is intended to mean an inclusive "or" rather than an exclusive "or." Moreover, articles "a" and "an" as used in the subject specification and annexed drawings should generally be construed to mean "one or more" unless specified otherwise or clear from context to be directed to a singular form.

What has been described above includes examples of a dishwasher basket 200 and method of use that provide advantages of the subject disclosure. It is, of course, not possible to describe every conceivable combination of components or methodologies for purposes of describing the subject disclosure, but one of ordinary skill in the art may recognize that many further combinations and permutations of the claimed subject matter are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

What is claimed is:

1. A dishwasher basket, comprising:

a container having a front face, a back face, two side faces, a bottom face, and a top edge;

an intermediate frame having a front face, a back face, two side faces, a top edge, and a bottom edge, and accommodating a height adjustable rack disposed therein which is adapted to connect to differing heights within an interior of the intermediate frame while remaining parallel to the bottom face of the container;

a lid having a front face, a back face, two side faces, a top face, and a bottom edge;

wherein the top edge of the container is connected to the bottom edge of the intermediate frame, and the top edge of the intermediate frame is connected to the bottom edge of the lid; and a connection assembly that hingedly couples the container, the intermediate frame and the lid, such that the intermediate frame and the lid pivot along at least one pivot axis relative to the container and independent of each other.

2. The dishwasher basket recited in claim 1, wherein the height adjustable rack is moveable from a first position to at least a second position and secured via a tray securing connection.

3. The dishwasher basket recited in claim 2, wherein the height adjustable rack is removable.

4. The dishwasher basket recited in claim 2, wherein the tray securing connection includes mating pairs of a plurality of apertures and protrusions.

5. The dishwasher basket recited in claim 4, wherein the apertures are at various respective heights along the intermediate frame and the protrusions extend from the edge of the adjustable rack.

6. The dishwasher basket recited in claim 1, wherein the lid further comprises at least one slot for securely holding a portion of a nipple.

7. The dishwasher basket recited in claim 6, wherein the nipple can be placed into an upper compartment of the lid through the slot without opening the lid.

8. The dishwasher basket recited in claim 6, wherein the at least one height adjustable rack is adapted to receive different sized nipples.

9. A dishwasher basket, comprising:

a container having a front face, a back face, two side faces, a bottom face, and a top edge;

an interior frame having a front face, a back face, two side faces, a top edge, and a bottom edge, and accommodating at least one height adjustable rack, wherein the adjustable rack is fastened horizontally via a tray securing assembly to vary a volume of an upper compartment and a lower compartment, and wherein the height adjustable rack is adjustable within the interior frame;

a lid having a front face, a back face, two side faces, a top face, and a bottom edge;

wherein the top edge of the container is connected to the bottom edge of the intermediate frame, and the top edge of the intermediate frame is connected to the bottom edge of the lid; and a connection assembly that hingedly couples the container, the interior frame and the lid, such that the interior frame and the lid pivot along at least one pivot axis relative to the container and independent of each other.

10. The dishwasher basket recited in claim 9, wherein the height adjustable rack is adjustable within an upper end and a lower end of the interior frame.

11. The dishwasher basket recited in claim 9, wherein the height adjustable rack is removable.

12. The dishwasher basket recited in claim 9, wherein the tray securing assembly includes mating pairs of a plurality of apertures and protrusions.

13. The dishwasher basket recited in claim 12, wherein the apertures are disposed at various respective heights along the interior frame and the protrusions extend from an edge of the height adjustable rack.

14. The dishwasher basket recited in claim 9, wherein a first pivot axis extends adjacent to a first edge of the interior frame, and where the interior frame lies adjacent to the container.

15. The dishwasher basket recited in claim 9, wherein the lid pivots along a second pivot axis adjacent to the interior frame.

16. The dishwasher basket recited in claim 15, wherein the second pivot axis extends adjacent to a second edge, wherein the lid lies adjacent to the interior frame.

17. The dishwasher basket recited in claim 9, wherein the lid further comprises at least one slot for securely holding a portion of a nipple.

18. The dishwasher basket recited in claim 17, wherein the slot is an elongated slot that can hold the nipple at a neck of the nipple.

19. The dishwasher basket recited in claim 17, wherein the nipple can be placed within the upper compartment through the slot without opening the lid.

20. The dishwasher basket recited in claim 9, wherein further comprising a straw mounting feature for securely holding a portion of a drinking straw.

21. A dishwasher basket, comprising:

a container having a front face, a back face, two side faces, a bottom face, and a top edge;

an intermediate frame having a front face, a back face, two side faces, a top edge, and a bottom edge, and accommodating an adjustable shelf, wherein the adjustable shelf is moveable from a first position to at least a second position and secured horizontally along a height of the intermediate frame via a shelf securing mechanism;

a lid having a front face, a back face, two side faces, a top face, and a bottom edge and having at least one slot for securely holding a portion of a nipple, wherein the nipple can be placed within the lid through the slot without opening the lid; and a connection assembly that hingedly couples the container, the intermediate frame and the lid, such that the intermediate frame and the lid pivot along at least one pivot axis relative to the container and independent of each other.

22. The dishwasher basket recited in claim 21, wherein the lid pivots along a second axis relative to the container, the lid and intermediate frame pivot independently of each other relative to the container.

* * * * *